US010113299B2

(12) United States Patent
Mizutani

(10) Patent No.: US 10,113,299 B2
(45) Date of Patent: Oct. 30, 2018

(54) EXCAVATING APPARATUS AND EXCAVATING METHOD

(71) Applicant: KOBELCO CONSTRUCTION MACHINERY CO., LTD., Hiroshima-shi (JP)

(72) Inventor: Motohiko Mizutani, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 15/722,686

(22) Filed: Oct. 2, 2017

(65) Prior Publication Data

US 2018/0094401 A1 Apr. 5, 2018

(30) Foreign Application Priority Data

Oct. 3, 2016 (JP) ..... 2016-195950

(51) Int. Cl.
*E02F 5/06* (2006.01)

(52) U.S. Cl.
CPC ..... *E02F 5/06* (2013.01)

(58) Field of Classification Search
CPC .... E02D 5/18; E02D 17/13; E02F 3/08; E02F 3/086; E02F 3/088; E02F 3/085; E02F 3/10; E02F 3/142; E02F 3/145; E02F 5/06; E02F 5/12; E02F 5/14
USPC ..... 37/195, 352, 355, 462, 465; 299/34.01, 299/76
See application file for complete search history.

(56) References Cited

U.S. PATENT DOCUMENTS 6,354,026 B1 * 3/2002 Trevisani ..... E02D 17/13 37/352
7,010,873 B2 * 3/2006 Kinoshita ..... E02F 5/06 37/352
8,079,163 B2 * 12/2011 Shreider ..... E02D 17/13 37/142.5
8,209,888 B2 * 7/2012 Lanser ..... E02F 3/10 299/34.01
8,966,790 B2 * 3/2015 van de Coterlet ..... E02F 3/10 37/352

(Continued)

FOREIGN PATENT DOCUMENTS

JP 9-3965 1/1997
JP 9-296441 11/1997

(Continued)

*Primary Examiner* — Robert E Pezzuto
(74) *Attorney, Agent, or Firm* — Oblon, McClelland, Maier & Neustadt, L.L.P.

(57) ABSTRACT

Provided are an excavating apparatus and an excavating method which are capable of reducing a shear force to be applied to a fastening member fixedly fastening an excavation blade plate and a chain together. A trench excavator serving as the excavating apparatus is equipped with a cutter post, a chain, a second cutter bit plate, and a shoe bolt. The second cutter bit plate includes a pair of restraint plates disposed on both sides of and across the chain in a width direction of the chain to extend from a reverse surface of a plate body. The pair of restraint plates are configured to be brought into contact with the cutter post along with a circulating movement of the chain and the second cutter bit plate, to thereby restrict the second cutter bit plate from being rotated about an axis extending along a circulating movement direction.

14 Claims, 20 Drawing Sheets

(56) References Cited

U.S. PATENT DOCUMENTS

2009/0260264 A1* 10/2009 Cooper ..... E02D 17/13
37/195

FOREIGN PATENT DOCUMENTS

| | | |
|---|---|---|
| JP | 11-81368 | 3/1999 |
| JP | 11-81369 | 3/1999 |
| JP | 2002-327450 | 11/2002 |
| JP | 2003-74084 | 3/2003 |
| JP | 2003-301477 | 10/2003 |
| JP | 2005-188262 | 7/2005 |
| JP | 2007-56664 | 3/2007 |

* cited by examiner

EXCAVATING APPARATUS AND EXCAVATING METHOD

TECHNICAL FIELD

The present invention relates to an excavating apparatus and an excavating method for use in forming a continuous wall, such as a soil-cement wall for water cut-off or substruction, below a ground surface.

BACKGROUND

A conventional excavating apparatus for excavating a ground to form a continuous trench below a ground surface includes a lower traveling body equipped with a crawler for traveling on the ground, an upper slewing body mounted on the under traveling body, and a portal frame provided in the upper slewing body. This portal frame is provided with a pair of traverse cylinders arranged one-above-the-other, and a leader. The pair of traverse cylinders are operable to slidingly move the leader in a traverse direction parallel to the ground surface. The excavating apparatus further includes a cutter post and a chain-type cutter.

The cutter post is suspended from the leader, and the chain-type cutter is configured to be circulatingly moved while being guided by the cutter post. The chain-type cutter includes an endless chain configured to be circulatingly driven, and a plurality of bit plates arranged on the endless chain on the side of an outer periphery thereof, at intervals along a circulating movement direction of the endless chain. On each of the bit plates, a plurality of excavation bits are arranged. By moving the cutter post below the ground surface in the traverse direction while circulatingly moving the chain-type cutters, a trench is excavated in a forward movement direction of the cutter post.

JP H09-296441A discloses a technique of circulatingly moving excavation bits along corners of a cutter post. JP 2003-74084A discloses a technique for preventing sag of a chain being circulatingly moved around a cutter post disposed at an angle, wherein the cutter post is provided with a guide mechanism for restricting a position of the chain.

Recent years, as regards excavation performance of an excavating apparatus, there has been a need to increase a width of a trench to be excavated. An increase in the trench width requires increasing a width of a bit plate supporting excavation bits. In this case, due to reaction forces applied from the ground, a large rotational moment is more likely to be generated in the bit plate. As a result, a strong shear force is applied to a bolt fixedly fastening the bit plate and a chain together, leading to a problem that loosening or disengagement of the bolt occurs.

SUMMARY

The present invention has been made in view of the above problem, and an object thereof is to provide an excavating apparatus and an excavating method capable of reducing a shear force to be applied to a fastening member fixedly fastening an excavation blade plate and a chain together According to a first aspect of the present invention, there is provided an excavating apparatus for forming a continuous trench below a ground surface. The excavating apparatus includes: an apparatus body disposed on the ground surface; a support member suspended from the apparatus body and disposed below the ground surface; an endless-shaped chain supported by the support member in such a manner as to be movable on an outer periphery of the support member along a given circulating movement plane in a given circulating movement direction; a plurality of excavation blade plates fixed to an outer peripheral surface of the chain at intervals along the circulating movement direction of the chain, wherein each of the excavation blade plates includes: a plate body extending longer than the chain in a width direction of the chain orthogonal to each of the circulating movement plane of the chain and the circulating movement direction of the chain, and having an obverse surface and a reverse surface; and a plurality of excavation blades arranged on the obverse surface of the plate body at least at opposite ends thereof in the width direction, in opposed relation to a ground below the ground surface, wherein the excavation blade plates are circulatingly movable integrally together with the chain to thereby excavate the ground; a plurality of fastening members fastening the chain and the excavation blade plates together in a direction parallel to the circulating movement plane and orthogonal to the width direction, in such a manner that the outer peripheral surface of the chain and the reverse surface of the plate body come into press contact with each other; a chain drive section which circulatingly moves the chain in the circulating movement direction; and a support member drive section which moves the support member in a given forward movement direction. The support member has a pair of restraining surfaces disposed in spaced-apart relation to each other in the width direction and each continuously extending in the circulating movement direction, and each of the excavation blade plates includes a pair of restraint members disposed on both sides of and across the chain in the width direction to extend from the reverse surface of the plate body, the pair of restraint members having, respectively, a pair of restraint-target surfaces each contactable with a corresponding one of the restraining surfaces of the support member at an arbitrary position in the circulating movement direction, in such a manner as to enable each of the excavation blade plates to be restrained from being rotated about an axis extending in the circulating movement direction.

According to a second aspect of the present invention, there is provided an excavating method for forming a continuous trench below a ground surface by circulatingly moving a plurality of excavation blade plates integrally together with an endless-shaped chain, wherein the endless-shaped chain is supported by a given support member in such a manner as to be movable on the support member along a given circulating movement plane in a given circulating movement direction, and the plurality of excavation blade plates are fixed to an outer peripheral surface of the chain at intervals in the circulating movement direction, and wherein each of the excavation blade plates includes: a plate body having an obverse surface and a reverse surface; and a plurality of excavation blades arranged on the obverse surface of the plate body at least at opposite ends thereof in a width direction of the chain orthogonal to each of the circulating movement plane and the circulating movement direction, in opposed relation to a ground below the ground surface. The excavating method includes an excavation step of excavating the ground by the excavation blades, while causing a pair of restraint members disposed on both sides of and across the chain in the width direction of the chain to extend from the reverse surface of the plate body of each of the excavation blade plates, to be brought into contact with the support member along with the circulating movement of the chain and the excavation blade plates, to thereby restrain each of the excavation blade plates from being rotated about an axis extending along the circulating movement direction.

DETAILED DESCRIPTION

Figure 1:
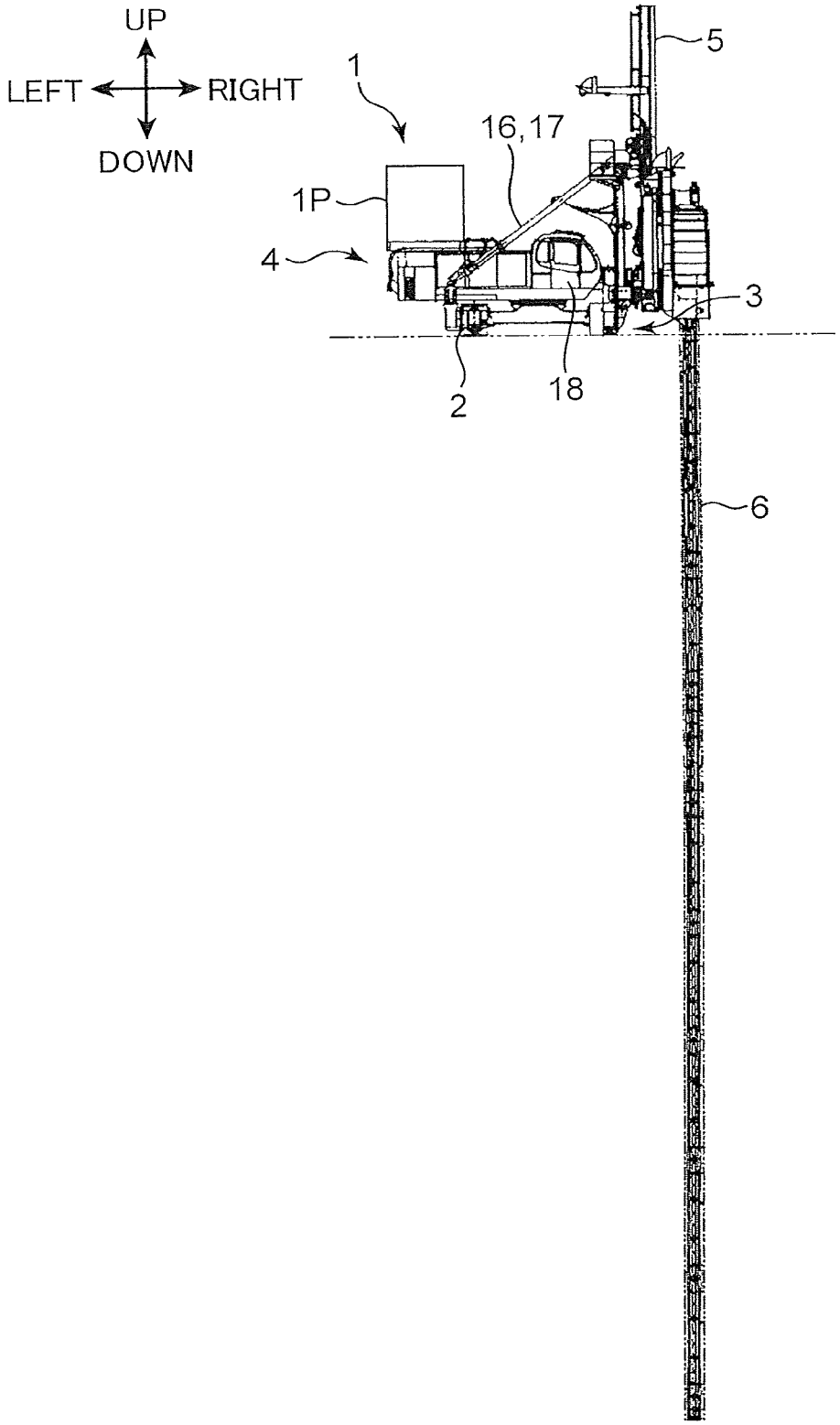
FIG. 1 is a side view depicting an overall configuration of an excavating apparatus according to a first embodiment of the present invention.
Figure 2:
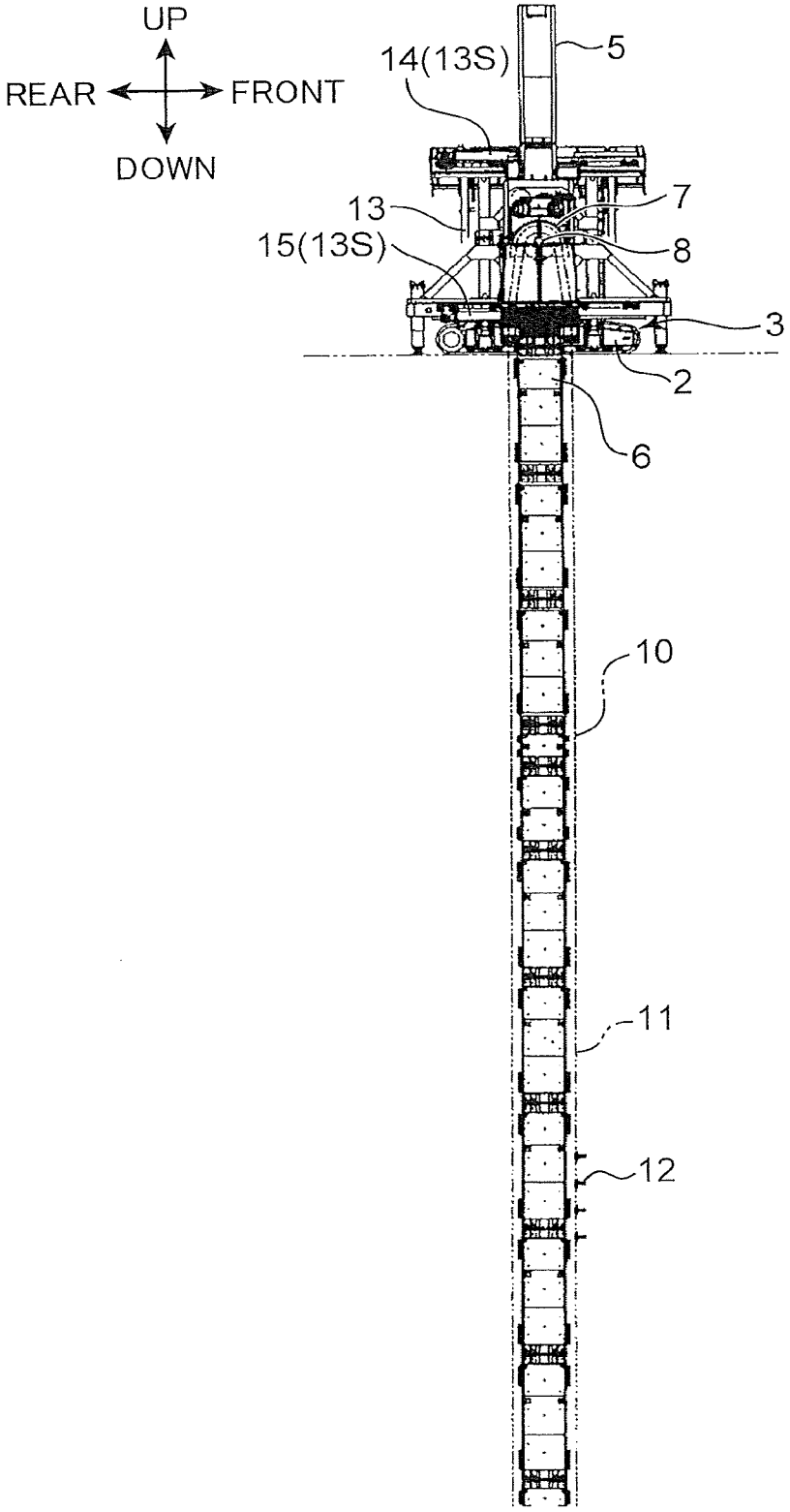
FIG. 2 is a front view depicting the overall configuration of the excavating apparatus according to the first embodiment.

With reference to the drawings, the present invention will now be described based on some preferred embodiments thereof. FIG. 1 is a side view depicting a trench excavator 1 (excavating apparatus) according to a first embodiment of the present invention, and FIG. 2 is a front view depicting the trench excavator 1. In each figure, directions, such as "up", "down", "front" and "rear", are indicated. However, it should be noted that these directions are shown only for the sake of describing a structure of a trench excavator 1 and an excavating method according to the present invention, but not meant to limit a usage mode and others of the trench excavator 1.

Figure 3:
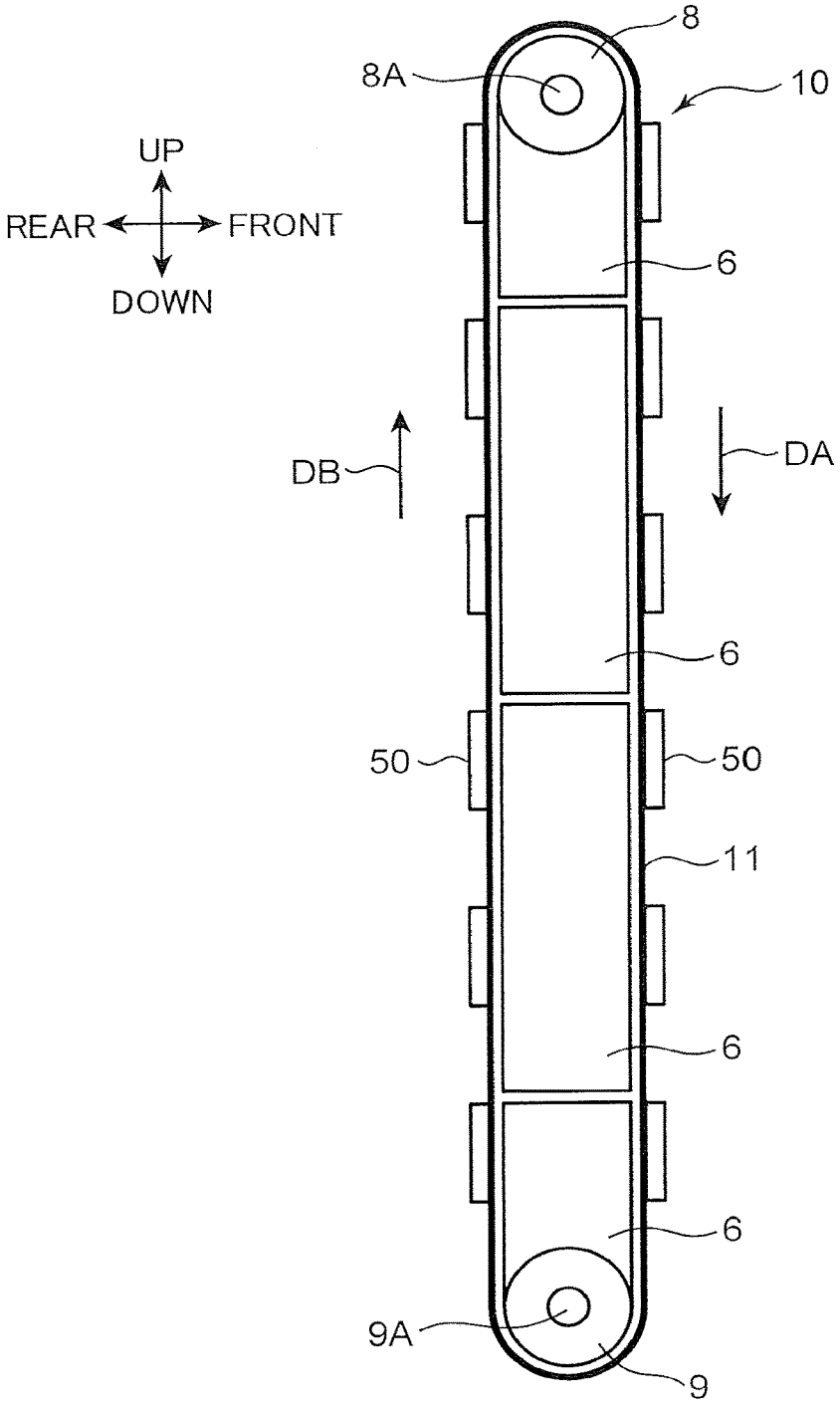
FIG. 3 is a schematic side view depicting a support member and a chain-type cutter of the excavating apparatus according to the first embodiment.

This trench excavator 1 includes a lower traveling body 3 equipped with a crawler 2 capable of moving on a ground surface, an upper slewing body 4 (apparatus body) mounted on the lower traveling body 3, a leader 5 provided on the upper slewing body 4 in a liftable and lowerable manner, a cutter post 6 (support member) suspended from the leader 5 and disposed below the ground surface, a rotary drive device 7 (chain drive section) and a moving mechanism 13S. FIG. 3 is a schematic side view depicting structures of the cutter post 6 and a chain-type cutter 10 of the trench excavator 1 according to the first embodiment.

The cutter post 6 is a rectangular parallelepiped-shaped box-like member, and a plurality of cutter posts 6 is coupled to each other in an upward-downward direction. The rotary drive device 7 includes a hydraulically-driven drive roller 8, and an idler roller 9 (FIG. 3). The drive roller 8 and the idler roller 9 are disposed, respectively, at an upper end and a lower end of the cutter posts 6 coupled each other. A chain cutter 10 is wound around between the drive roller 8 and the idler roller 9 in a circulatingly movable manner. The rotary drive device 7 is operable to circulatingly move an after-mentioned chain 11 along a circulating movement direction DA (FIG. 3). A power unit 1P is operable to supply a hydraulic pressure to the rotary drive device 7.

As depicted in FIG. 3, the chain-type cutter 10 includes an endless-shaped chain 11, and a plurality of cutter bit plates 50 arranged on the side of an outer periphery of the chain 11. The chain 11 is supported by the cutter post 6 in such a manner as to be movable on an outer periphery of the cutter post 6 along a given circulating movement plane in a given circulating movement direction. The circulating movement plane of the chain 11 means a plane parallel to a surface of the drawing sheet of FIG. 3, i.e., a plane including a trajectory drawn by one of opposite side edges of the chain 11 during the circulating movement. The circulating movement direction of the chain 11 being circulatingly moved is indicated by the arrowed lines DA, DB in FIG. 3. Further, as used in the following description, the term "width direction" of the chain 11 is equivalent to a direction orthogonal to each of the circulating movement plane and the circulating movement direction, i.e., a direction orthogonal to a surface of the drawing sheet of FIG. 3 (rightward-leftward direction in FIG. 3).

The cutter bit plates 50 are a plurality of plate-shaped members fixed to an outer peripheral surface of the chain 11 at intervals in the circulating movement direction of the chain 11. Each of the cutter bit plates 50 includes a plurality of excavation bits 12 (FIG. 2) (excavation blades). The excavation bits 12 are arranged at least at widthwise opposite ends of the cutter bit plate 50 (at opposite ends of the cutter bit plate 50 in the width direction), in opposed relation to a ground below the ground surface. Each of the excavation bits 12 is composed of a cemented carbide tip. The cutter bit plates 50 are configured to be circulatingly moved integrally together with the chain 11 to thereby excavate the ground.

The drive roller 8 is provided with a tension adjustment mechanism for adjusting tension of the chain 11. In FIG. 3, according to a rotary drive force received from the drive roller 8, the chain-type cutter 10 is circulatingly movable such that a region thereof forward of the cutter post 6 is moved in the direction indicated by the arrowed line DA (vertically downward direction), and a region thereof rearward of the cutter post 6 is moved in the direction indicated by the arrowed line DB (vertically upward direction). The idler roller 9 is configured to be rotated while being driven by the chain 11 of the chain-type cutter 10. Further, as depicted in FIG. 3, the drive roller 8 includes a drive roller shaft 8A, and the idler roller 9 includes an idler roller shaft 9A.

The upper slewing body 4 is provided with a portal frame 13 (FIG. 2) on which the moving mechanism 13S (support member drive section) is disposed. The moving mechanism 13S includes an upper traverse cylinder 14 disposed on an upper portion of the portal frame 13, and a lower traverse cylinder 15 disposed on a lower portion of the portal frame 13. The upper traverse cylinder 14 and the lower transverse cylinder 15 are disposed in parallel relation to each other.

The lower traverse cylinder 15 is configured to move the cutter post 6 in a given forward movement direction (forward direction) according to thrust $F_{PL}$ thereof so as to push the cutter post 6 toward the ground. In this process, the upper traverse cylinder 14 is configured to generate a cylinder holding force in a direction opposite to the pushing force of the lower traverse cylinder 15.

The reference signs 16, 17 in FIG. 1 denote a pair of backstays (only a front-side one of them appears in FIG. 1) supporting the leader 5. Further, a cabin 18 on which an operator can ride is mounted on the upper slewing body 4.

The trench excavator 1 is configured to perform excavation in such a manner as to move the excavation bits 12 of the chain-type cutter 10 in an approximately vertical direction while horizontally pushing the cutter post 6 inserted in the ground, i.e., by the principle of scraping or shaving using a plane, on a per-pattern basis. As used here, the term "one pattern (per pattern)" means a region to be excavated by a group of the excavation bits 12 provided in the chain-type cutter 10 along the circulating movement direction.

If the thrust $F_{PL}$ of the lower traverse cylinder 15 becomes insufficient, a traversing speed of excavation is lowered, resulting in disabling of excavation of the ground. As one example, a rated thrust $F_{PL}$ of the lower traverse cylinder 15 of the trench excavator 1 according to the first embodiment is 539 kN.

In this regard, the following relation is satisfied:

$$Lp:tpx=Vb:Ve, \quad \text{(Formula 1)}$$

where Vb: tangential speed (min/see), Ve: excavation speed (mm/Hr), Lp: one pattern length (mm) for full-face excavation, and tpx: cutting depth (mm) per pattern. The following Formula 2 is derived from the Formula 1:

$$tpx=Ve\times Lp/Vb \quad \text{(Formula 2)}$$

Thus, the cutting depth tpx per pattern can be calculated from Formula 2.

Figure 4:
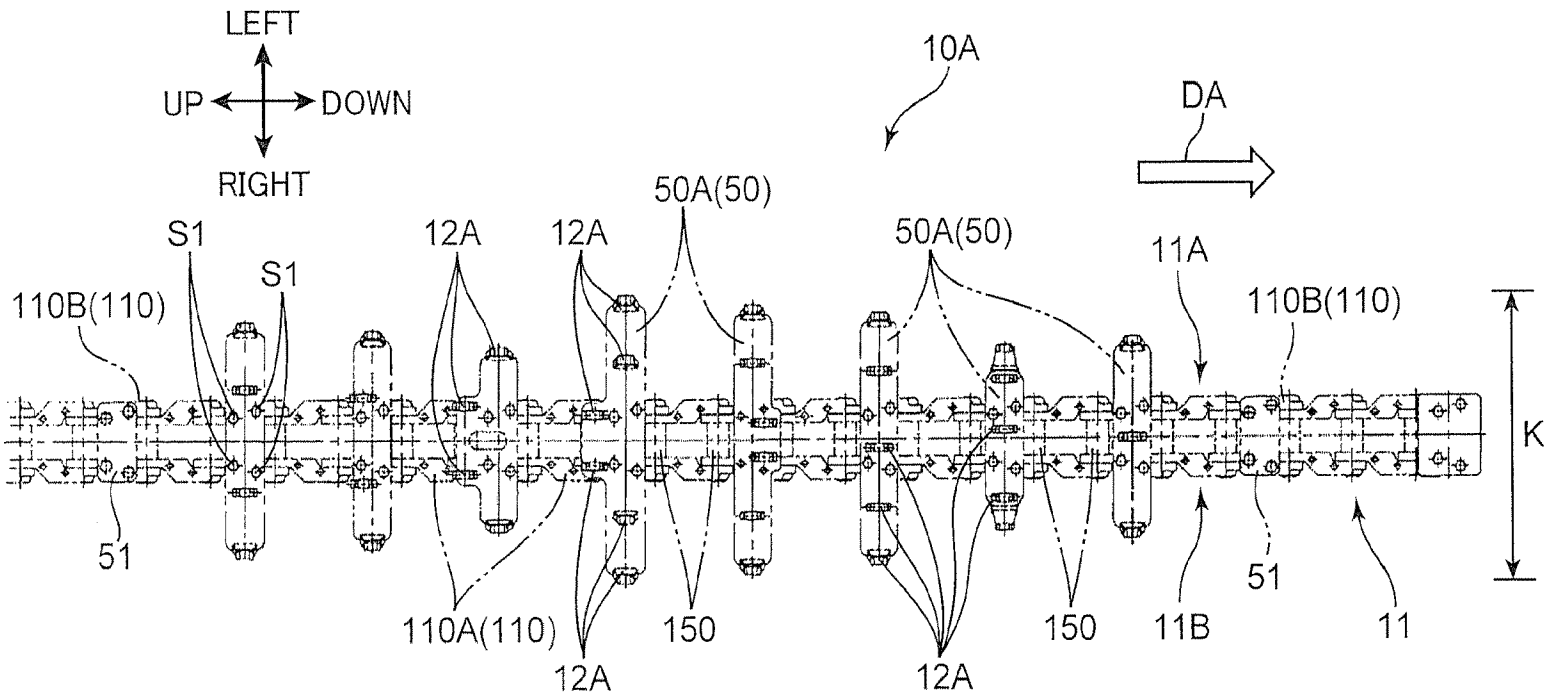
FIG. 4 is a front view depicting a portion of the chain-type cutter of the excavating apparatus according to the first embodiment.
Figure 5:
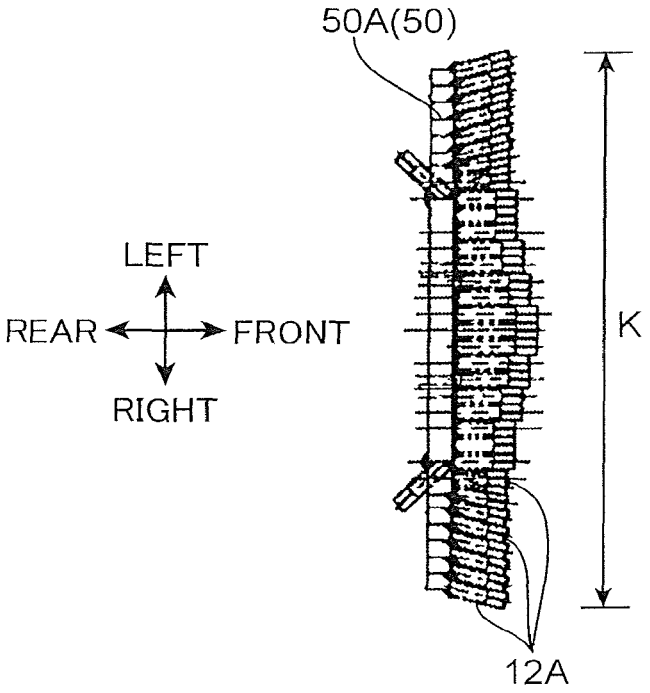
FIG. 5 is a top view depicting the portion of the chain-type cutter of the excavating apparatus according to the first embodiment.
Figure 6:
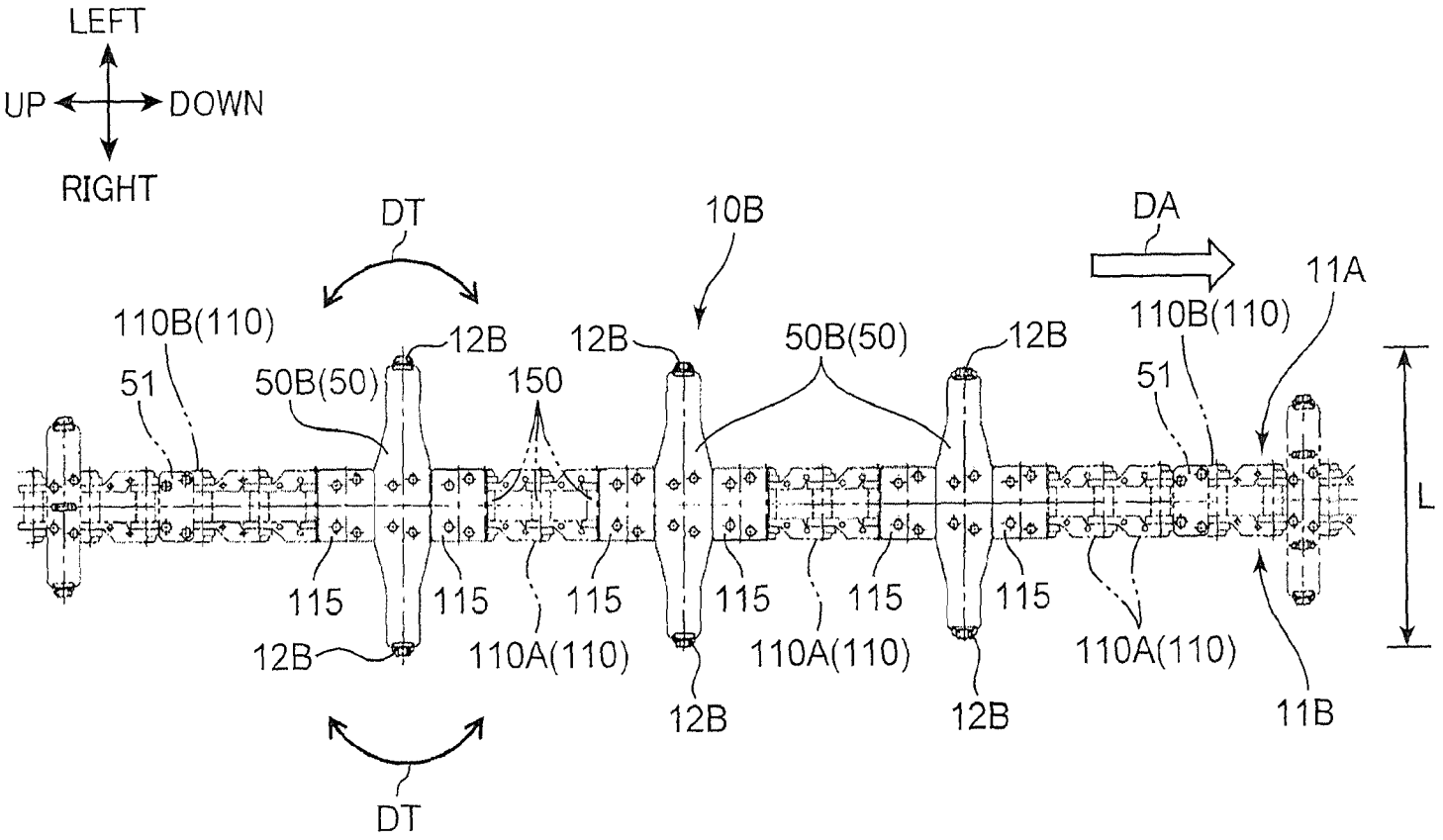
FIG. 6 is a front view depicting a portion of the chain-type cutter of the excavating apparatus according to the first embodiment.
Figure 7:
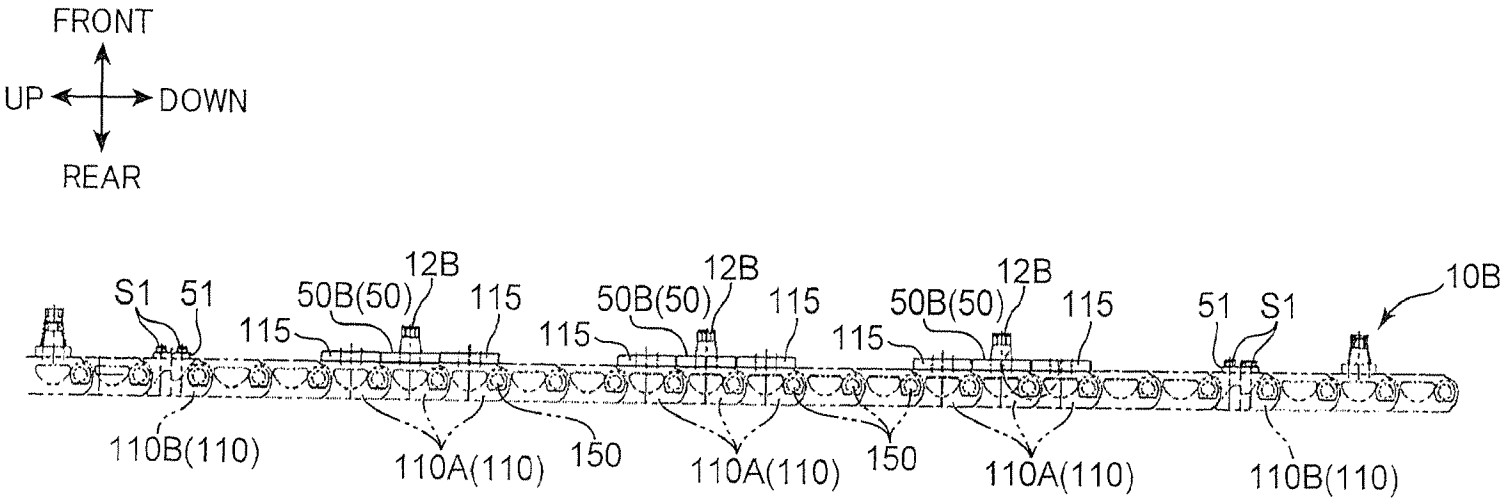
FIG. 7 is a side view depicting the portion of the chain-type cutter of the excavating apparatus according to the first embodiment.
Figure 8:
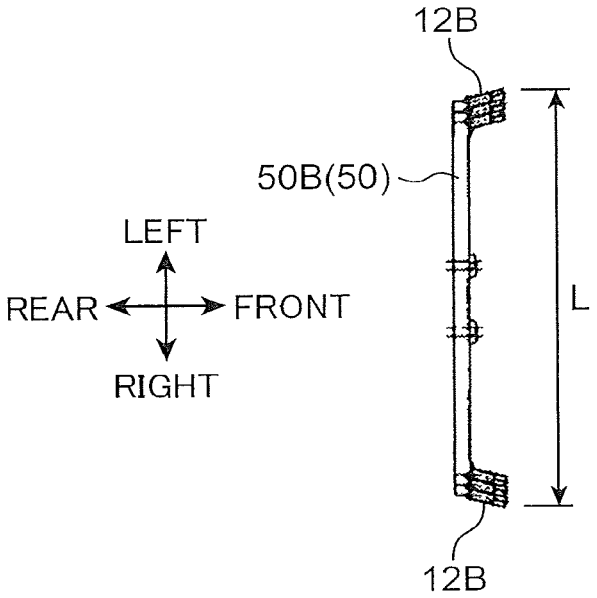
FIG. 8 is a top view depicting the portion of the chain-type cutter of the excavating apparatus according to the first embodiment.

FIG. 4 is a front view depicting a portion (10A) of the chain-type cutter 10 of the trench excavator 1 according to the first embodiment. FIG. 5 is a top view depicting the portion (10A) of the chain-type cutter 10. FIG. 6 is a front view depicting a portion (10B) of the chain-type cutter 10 of the trench excavator 1, and FIG. 7 and FIG. 8 are, respectively, a side view and a top view depicting the portion (10B) of the chain-type cutter 10.

The chain-type cutter 10 in the first embodiment is formed by alternately coupling a first cutter unit 10A depicted in FIG. 4 and a second cutter unit 10B depicted in FIG. 6, in the circulating movement direction of the chain-type cutter 10. The mode of coupling between the first cutter unit 10A and the second cutter unit 10B is not limited thereto, but may be any suitable mode such as a mode in which two first cutter units 10A are successively coupled together, and then a second cutter unit 10B is coupled thereto. In the first embodiment, the alternately coupled first and second cutter units 10A, 10B includes the aforementioned group of excavation bits 12.

The chain 11 constituting the alternately coupled first and second cutter units 10A, 10B is formed by arranging and mutually coupling a plurally of pairs of links 110A or half links 110B in the circulating movement direction (see FIG. 7), wherein each of the pairs of links 110A or half links 110B are arranged with a distance therebetween in a width direction of the chain 11. In the first embodiment, one half-links 110B is interposed between two groups of seventeen links 110A. Adjacent ones of the links 110A and the half-links 11B are coupled together by a fixing pin 150 (FIG. 7). In other words, the chain 11 includes a pair of strip members 11A, 11B (FIG. 6) each formed in an endless shape and arranged with a distance therebetween in the width direction, and a fixing pin 150 coupling the pair of strip members 11A, 11B together in such a manner as to enable the distance between the strip members to be kept constant. Outer peripheral surfaces of the strip members 11A, 11B are equivalent to the outer peripheral surface of the chain 11. Each of the strip members 11A, 11B includes a plurality of links 110A (half-links 110B) arranged side-by-side adjacent relation to each other in the circulating movement direction, and a fixing pin 150 coupling adjacent ones of the links 110A together . That is, the fixing pin 150 mutually couples the strip members 11A, 11B arranged in adjacent relation in the width direction, and mutually couples adjacent ones of the links 110A arranged side-by-side along the circulating movement direction.

Figure 9:
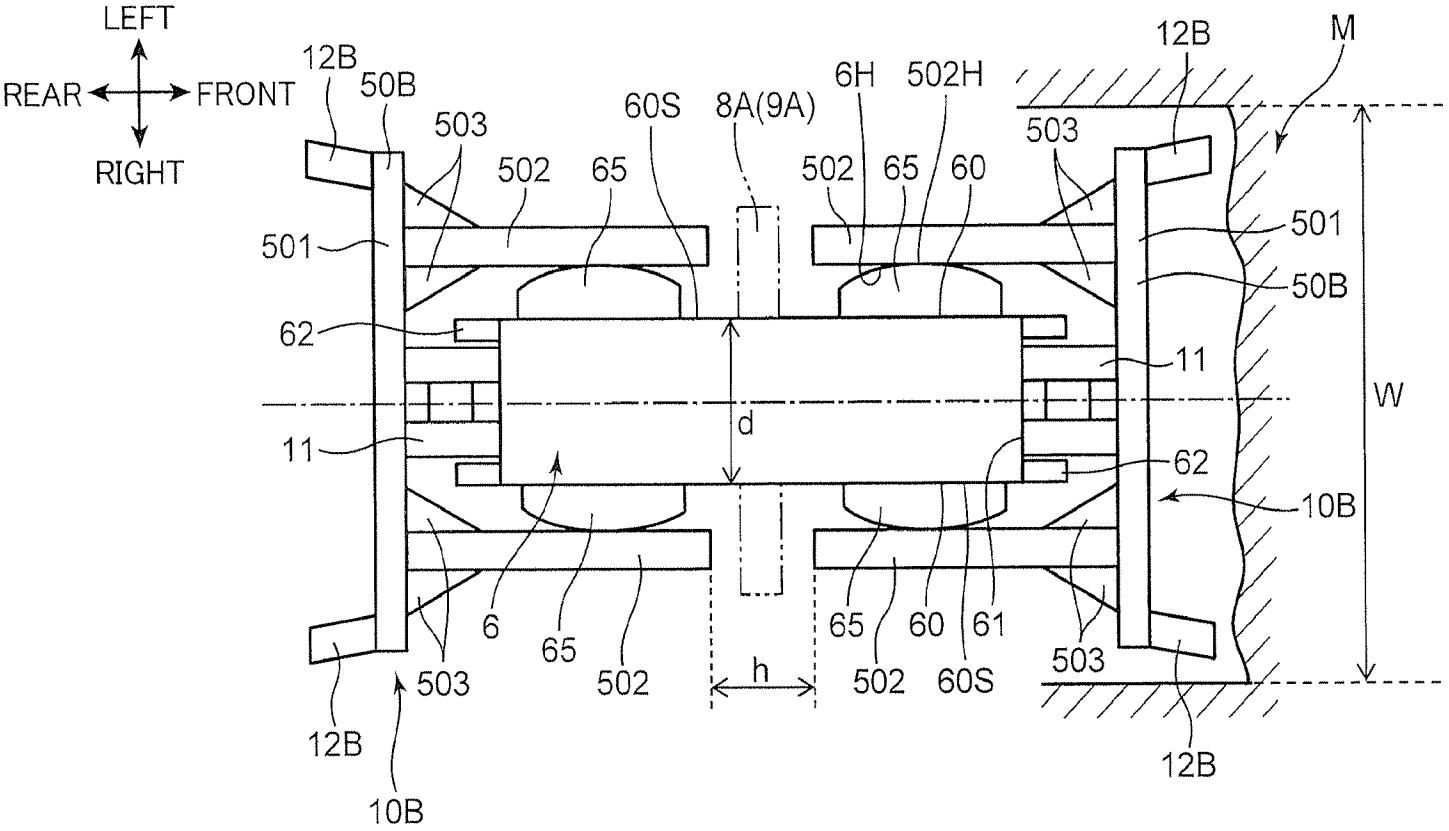
FIG. 9 is a schematic sectional view depicting structures of the support member and the chain-type cutter of the excavating apparatus according to the first embodiment.

The first cutter unit 10A has a function of excavating a widthwise inward region of an excavation width W by which the chain-type cutter 10 can excavate a ground M (see FIG. 9). The first cutter unit 10A includes a plurality of first cutter bit plates 50A fixed on the chain 11. In the first embodiment, eight first cutter bit plates 50A are arranged per first cutter unit 10A. Each of the first cutter bit plates 50A is one example of the cutter bit plate 50. Each of the first cutter bit plates 50A is fixed onto a corresponding one of the links 110A of the chain 11 by plural (four) sets of a shoe bolt S1 and a non-depicted nut (FIG. 4). The first cutter bit plates 50A of the first cutter unit 10A are configured such that respective widthwise lengths thereof become different from each other. It should be noted that the widthwise lengths of some of the first cutter bit plates 50A may be set to the same value.

A plurality of first excavation bits 12A are fixed on each of the first cutter bit plates 50A. In the first embodiment, a maximum span K (FIG. 4, FIG. 5) of the first excavation bits 12A of the first cutter units 10A is set to 850 mm. As depicted in FIG. 5, when viewing the first cutter bit plates 50A in the circulating movement direction DA, the first excavation bits 12A provided on each of the first cutter bit plate 50A are continuously arranged over the entire maximum span K in the width direction. As a result, a region of the excavation width W of the ground M corresponding to the maximum span K will be excavated by the first cutter unit 10A.

Referring to FIGS. 6 to 8, the second cutter unit 10B has a function of excavating a widthwise outward region of the excavation width W by which the chain-type cutter 10 can excavate the ground M (see FIG. 9).

The second cutter unit 10B includes a plurality of second cutter bit plates 50B fixed on the chain 11. Each of the second cutter bit plates 50B is another example of the cutter bit plate 50. In the first embodiment, three second cutter bit plates 50B are provided per second cutter unit 10B. It should be noted that two cutter bit plates appearing at opposite ends in FIG. 6 are the first cutter bit plates 50A (FIG. 4) of the adjacent first cutter units 10A. Each of the second cutter bit plates 50B is fixed onto a corresponding one of the links 110A of the chain 11 by plural sets of a shoe bolt S1 and a non-depicted nut (FIG. 7).

Each of the second cutter bit plates 50B is configured such that a widthwise length thereof become slightly different from those of the first cutter bit plates 50A. A plurality of second excavation bits 12B are fixed on each of the second cutter bit plates SOB. In the first embodiment, a maximum span L (FIG. 6, FIG. 8) of the second excavation bits 12B is set to 1000 mm. As depicted in FIG. 8, when viewing the second cutter bit plates 50B in the circulating movement direction DA, the second excavation bits 12B provided on each of the second cutter bit plate SOB are concentratedly arranged at widthwise opposite ends of the maximum span L. As a result, a region of the excavation width W of the ground M corresponding to the widthwise opposite ends of the maximum span L will be excavated by the second cutter unit 10B.

The second cutter unit 10B also includes a scrum plate 115. As depicted in FIGS. 6 and 7, a pair of scrum plates 115 are arranged, respectively, on upstream and downstream sides of each of the second cutter bit plates 50B in the circulating movement direction DA. Each of the scrum plates 115 is fixed onto a corresponding one of the links 110A by plural (four) sets of a shoe bolt S1 and a nut. The pair of scrum plates 115 are arranged across the second cutter bit plate 50B, in such a manner that one side edge of each of the scrum plates 115 is in contact with a corresponding one of opposite side edges of the second cutter bit plate 50B.

Figure 10:
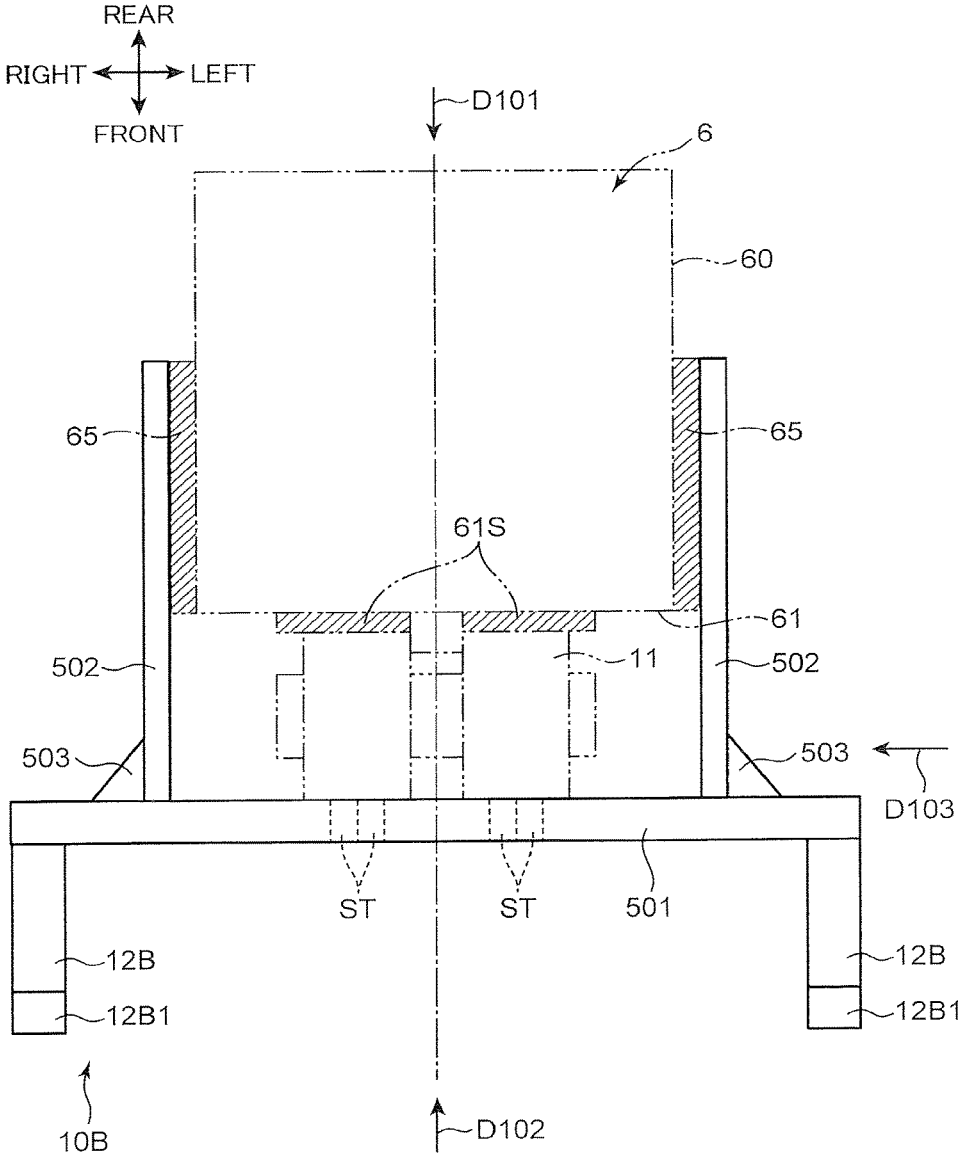
FIG. 10 is a top view depicting the structure of the chain-type cutter of the excavating apparatus according to the first embodiment.
Figure 11:
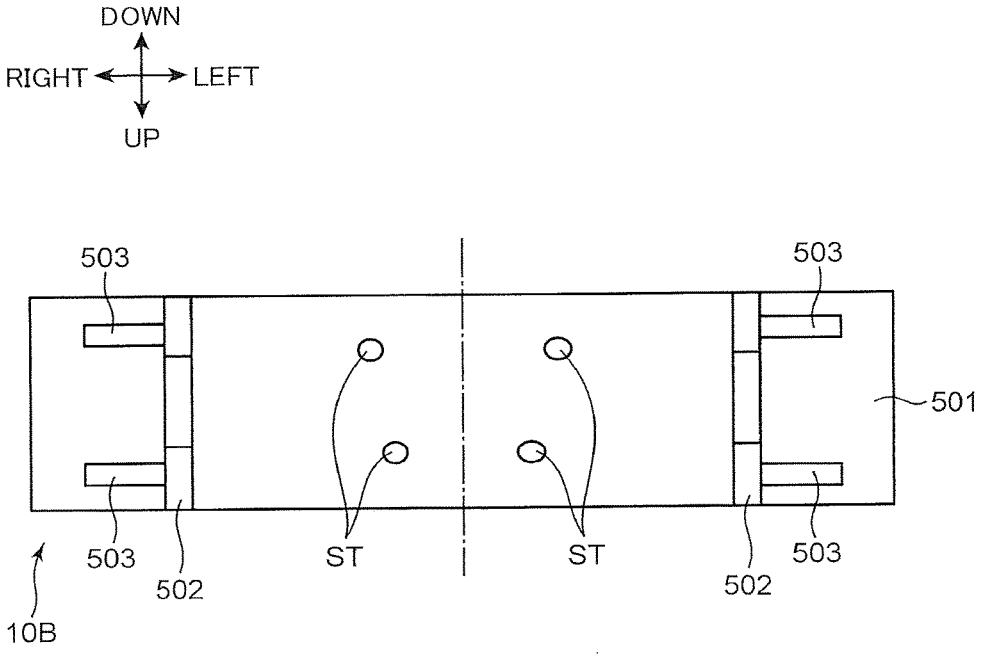
FIG. 11 is a back view depicting the structure of the chain-type cutter of the excavating apparatus according to the first embodiment.
Figure 12:
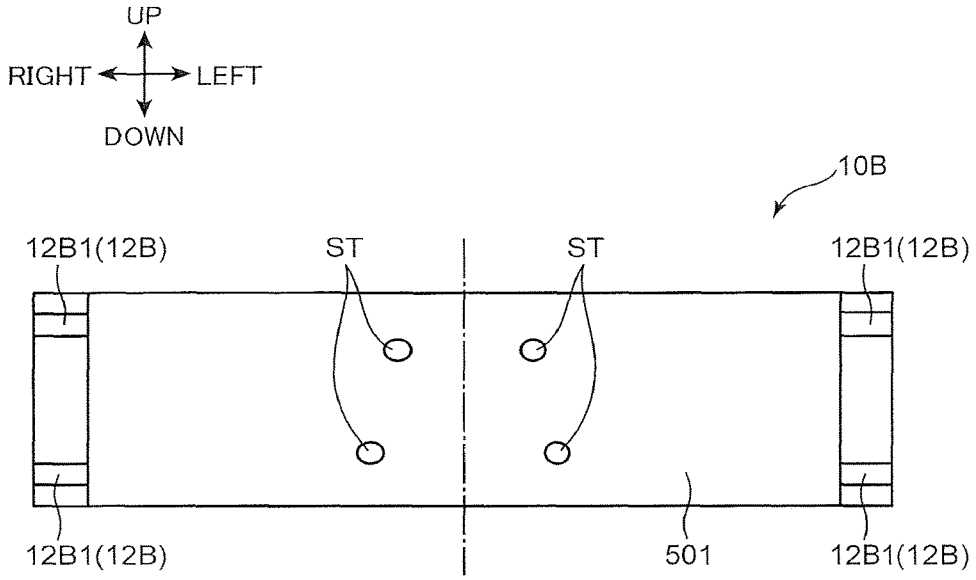
FIG. 12 is a front view depicting the structure of the chain-type cutter of the excavating apparatus according to the first embodiment.
Figure 13:
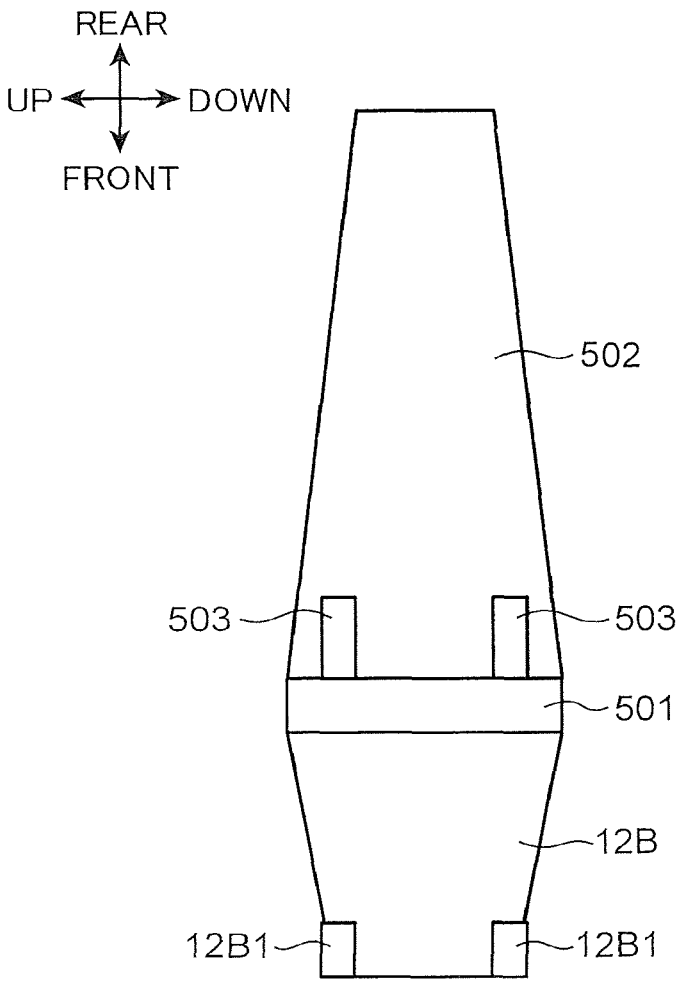
FIG. 13 is a side view depicting the structure of the chain-type cutter of the excavating apparatus according to the first embodiment.

FIG. 9 is a schematic sectional view depicting structures of the cutter post 6 and the second cutter unit 10B of the trench excavator 1 according to the first embodiment. FIG. 10, FIG., 11, FIG. 12 and FIG. 13 are, respectively, a top view, a back view, a front view and a side view depicting the structure of the second cutter unit 10B in the first embodiment. FIG. 11, FIG. 12 and FIG. 13 are equivalent, respectively, to views of the second cutter unit 10B in FIG. 10, as viewed along the arrowed lines D101, D102, D103.

Referring to FIGS. 9 to 13, the cutter post 6 includes: a pair of lateral walls 60; a pair of support walls 61 each connecting the pair of lateral walls 60 together; a pair of opposing walls 62 (FIG. 9) disposed on each of the pair of support walls 61; and a pair of chain sliding portions 61S (FIG. 10).

Each of the pair of support walls 61 is a wall of the cutter post 6 supporting the second cutter unit 10B (chain-type cutter 10) in a circulatingly movable manner. For this purpose, each of the support walls 61 is disposed in opposed relation to the plate body 501 of the second cutter unit 10B to extend along a rightward-leftward direction (the width direction of the chain 11). Each of the pair of lateral walls 60 extends along a direction orthogonal to the pair of support walls 61 (forward-rearward direction). The pair of lateral walls 60 are disposed, respectively, on widthwise opposite-end sides of each of the pair of support walls 61, and each of the lateral walls 60 has an aftermentioned restraining surface 6H. The pair of opposing walls 62 (FIG. 9) are provided to protrude, respectively, from opposite ends of the support wall 61 in the rightward-leftward direction. The chain 11 is received in a space between the pair of opposing walls 62. It should be noted that depiction of the opposing walls 62 is omitted in FIG. 10.

Each of the pair of chain sliding portions 61S is a plate-shaped member fixed to the support wall 61 at a position inward of the pair of opposing walls 62. As each of the chain sliding portions 61S, a member having low frictional resistance and high slidability is employed. Further, as a material for the chain sliding portions 61S, it is possible to use a hard resin or a wear-resistant metal. Each of the opposing walls 62 and the chain sliding portions 61S extends long over the entire length of the cutter post 6 in the upward-downward direction, to have a function of guiding the circulating movement of the chain 11.

The cutter post 6 further includes a guide portion 65. As depicted in FIG. 9, two guide portions 65 are provided on each of the pair of right and left lateral walls 60, with a distance therebetween in the forward-rearward direction. Alternatively, in another embodiment, the two guide portions 65 disposed on one of the lateral walls 60 may be formed as a single member. A pair of the guide portions 65 are configured to come into contact with respective ones of a pair of aftermentioned restraint plates 502, and have a function of guiding the circulating movement of the second cutter unit 10B. In FIG. 9, a shape of an outer peripheral surface of each of the guide portions 65 is exaggeratingly depicted. Specifically, the outer peripheral surface of each of the guide portions 65 is formed in an arc shape convexed toward a corresponding one of the aftermentioned restrain plates 502. This arc shape is a gentle curve, i.e., an actual cross-sectional shape of the guide portion 65 is approximately equal to a rectangular shape, as viewed in the same manner as that in FIG. 10. As each of the guide portions 65, a member having low frictional resistance and high slidability is employed, as with the chain sliding portions 61S. Further, as a material for the guide portions 65, it is possible to use a hard resin or a wear-resistant metal. As above, the cutter post 6 has the guide portions 65. In other words, the cutter post 6 has a pair of restraining surfaces 6H disposed in spaced-apart relation to each other in the width direction and each continuously extending along the circulating movement direction of the chain 11. In the first embodiment, the restraining surfaces 6H are composed of the outer peripheral surfaces of the guide portions, and the cutter post 6 is disposed such that each of the restraining surfaces faces outwardly in the width direction (outwardly in the rightward-leftward direction).

In other words, each of the lateral walls 60 in the first embodiment includes a base surface 60S, and a guide portion 65 (protruding portion) protruding from the base surface 60S outwardly in the width direction and extending along the circulating movement direction, wherein the guide portion 65 has a restraining surface 6H. Referring to FIGS. 9 and 10, each of the cutter bit plates 50B fixed to the chain 11 includes a plate body 501, a pair of restraint plates 502

(restraint members), a plurality of reinforcement ribs 503 (fall-down restraining member), and the aforementioned second excavation bits 12B.

The plate body 501 is a plate-shaped portion extending longer than the chain 11 in the width direction of the chain 11 (rightward-leftward direction), and has an obverse surface facing the ground M and a reverse surface on a side opposite to the obverse surface. The second excavation bits 12B are fixed at opposite ends of the obverse surface of the plate body 501. In FIG. 10, a bit tip 12B1 made of an ultra-hard material appears at a distal end of each of second excavation bits 12B. As depicted in FIG. 13, a plurality of the bit tips 12B1 are arranged at intervals in the circulating movement direction (upward-downward direction). The reverse surface (in FIG. 10, a rear surface) of the plate body 501 is brought into contact with and supported by the outer peripheral surface of the chain 11. The plate body 501 is formed with four bolt holes ST, and the second cutter bit plate 50B is fastened to the chain 11 by four shoe bolts S1 (FIG. 7) each inserted into a respective one of the bolt holes ST and non-depicted four nuts.

The pair of restraint plates 502 are disposed on both sides of and across the chain 11 in the rightward-leftward direction (width direction) to extend from the reverse surface of the plate body 501. The pair of restraint plates 502 are configured to be brought into contact or sliding contact with corresponding one of the guide portions 65 of the cutter post 6 during the circulating movement of the chain 11 and the second cutter unit 10B, to thereby restrain the second cutter unit 10B from being rotated about an axis extending along the circulating movement direction (upward-downward direction orthogonal to the drawing sheets of FIGS. 9 and 10). In the first embodiment, the pair of restraint plates 502 are arranged to sandwich the cutter post 6 therebetween in the rightward-leftward direction, and brought into contact with corresponding ones of the guide portions 65 along the rightward-leftward direction. For this purpose, the restraint plates 502 have, respectively, a pair of restraint-target surfaces 502H each contactable with a corresponding one of the restraining surfaces 6H of the cutter post 6 at an arbitrary position in the circulating movement direction of the chain 11. Each of the restraint-target surfaces 502H is disposed outward of and in opposed relation to a corresponding one of the restraining surfaces 6H, in the width direction (FIG. 9). As above, the drive roller 8 and the idler roller 9 are arranged, respectively, at the upper end and the lower end of the cutter post 6, as depicted in FIG. 3. Thus, in order to prevent interference between the restraint plates 502 and each of the drive roller shaft 8A of the drive roller 8 and the idler roller shaft 9A of the idler roller 9, along with the circulating movement of the chain-type cutter 10, a distal end of each of the restraint plates 502 is disposed with a given distance with respect to each of the drive roller shaft 8A and the idler roller shaft 9A (FIG. 9). Therefore, the distance h in FIG. 9 becomes greater than a diameter of each of the drive roller shaft 8A and the idler roller shaft 9A.

The plurality of reinforcement ribs 503 are disposed at a base end of each of the restraint plates 502 to restrain fall-down of the restraint plate 502 with respect to the plate body 501 in a cross-section orthogonal to the circulating movement direction of the chain 11. In FIG. 9, two reinforcement ribs 503 are disposed, respectively, on right and left sides of each of the restraint plates 502. Alternatively, a reinforcement rib 503 may be disposed on one of the right and left sides of each of the restraint plates 502, as depicted in FIG. 10. In this case, two or more reinforcement ribs 503 are preferably disposed on the one side, at certain intervals in the upward-downward direction, as depicted in FIG. 11. The number of the reinforcement ribs 503 is not particularly limited. Further, the reinforcement rib 503 may be formed integrally with or separately from the restraint plate 502.

As above, in the first embodiment, each of the second cutter bit plates 50B of the second cutter unit 10B has the structure as depicted in FIGS. 9 to 13. On the other hand, each of the first cutter bit plates 50A of the first cutter unit 10A is devoid of the restraint plates 502 and the reinforcement ribs 503 in the structure depicted in FIGS. 9 and 10. That is, a reverse surface of each of the first cutter bit plates 50A has a flat shape along the rightward-leftward direction. In the case, each of the first cutter bit plates 50A is fixedly fastened to the chain 11 by four sets of a shoe bolt S1 and a non-depicted nut, as with the second cutter unit 10B.

Figure 20:
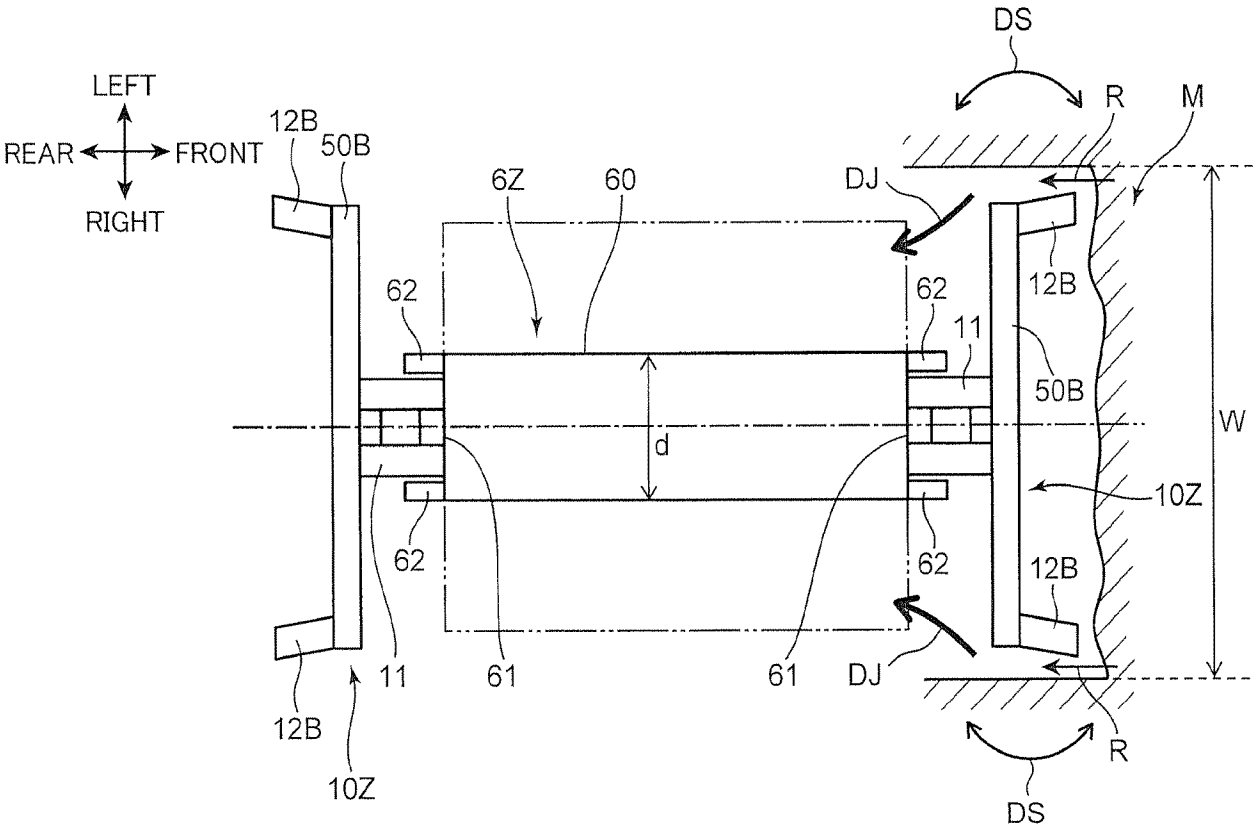
FIG. 20 is a schematic sectional view depicting structures of a support member and a chain-type cutter of another excavating apparatus to be compared with the excavating apparatuses according to the first embodiment.

FIG. 20 is a top view of a cutter post 6Z and a cutter unit 10Z in another trench excavator to be compared with the trench excavator 1 according to the first embodiment. This comparative trench excavator is equivalent to a trench excavator obtained by removing the restraint plates 502 and the reinforcement ribs 503 of the second cutter unit 10B (FIG. 9) and the guide portions 65 of the cutter post 6 (FIG. 9) from the trench excavator 1 according to the first embodiment. The following description will be made about a problem of the trench excavator depicted in FIG. 20. In FIG. 20, any element or member having the same function and structure as those of the element or member of the cutter post 6 or the second cutter unit 10B in the first embodiment is assigned with the same reference sign as that in FIG. 9.

The cutter unit 10Z has a function of excavating the widthwise outward region of the excavation width W of the ground M (FIG. 20), as with the second cutter unit 10B in the first embodiment. In a conventional excavating apparatus for use in forming a continuous wall such as a soil-cement wall for water cut-off or substruction, the excavation width W has been set within 850 mm, in many cases. On the other hand, recently, it is expected to enable such a continuous wall to be employed as an exterior wall, as well as a water cut-off wall and a substruction wall, thereby leading to a need to increase the excavation width W.

As depicted in FIG. 20, when the excavation width W is increased under a condition that a width d of the cutter post 6Z is fixed, a posture of a second cutter bit plate 50B of the cutter unit 10Z is likely to become unstable. In the case where there is a difference between reaction forces R received from the ground M by a pair of second excavation bits 12B of the second cutter bit plate 50B, a rotational moment indicated by the arrowed line DS in FIG. 20 (a moment causing the second cutter bit plate 50B to be rotated in a cross-section orthogonal to a circulating movement direction of the chain-type cutter 10) is given to the second cutter bit plate 50B. Further, when the second cutter bit plate 50B is moved around the cutter post 6Z together with a chain 11, a rotational moment indicated by the arrowed line DT in FIG. 6 (a moment causing the second cutter bit plate 50B to be rotated in a plane including the circulating movement direction of the chain-type cutter 10Z and a width direction of the chain 11) is given to the second cutter bit plate 50B. When such rotational moments are given to the second cutter bit plate 50B, a large shear force is applied to a shoe bolt (FIG. 7) by which the second cutter bit plate 50B and the chain 11 are fixedly fastened together, possibly leading to loosening, disengagement, breakage or the like of the shoe bolt S1. Such rotational moments notably occur in the second cutter bit plate 50B (FIG. 6) having a widthwise length set to be greater than that of a first cutter bit plate 50A (FIG. 4).

In FIG. 20, with a view to stabilizing the posture of the second cutter bit plate 50B, it is conceivable to increase the width d of the cutter post 6 so as to form the cutter post 6 to have the shape indicated by the two-dot chain line in FIG. 20. In this case, however, the cutter post 6 is disposed on back sides of the second excavation bits 12B (on back sides of opposite ends of the second cutter bit plate 50B). This prevents soil of the ground excavated by the second excavation bits 12B from flowing as indicated by the arrowed lines DJ. Thus, a large pressure is applied around the second cutter bit plate 50B, leading to difficulty in circulating movement and forward movement of the chain-type cutter 10. In other words, in the case where a maximum span of the second excavation bits 12B of the second cutter bit plate SOB is set to be greater than the width d of the cutter post 6, as in FIG. 20, the flow of excavated soil (arrowed lines DJ) is smoothly formed, so that it becomes possible to smoothly perform excavation operation for a wider excavation width W. As a result of plural experiments, the present inventor found that, in the case where the maximum span L (FIG. 6) of the pair of second excavation bits 12B of the second cutter bit plate 50B is 1000 mm or more, the above effect is significantly brought out by satisfying the following relationship: $L \geq d \times 2.5$. On the other hand, the use of such a structure leads to problems of the rotational moments received by the second cutter bit plate 50B and the shear force S1 applied to the shoe bolt S1.

In order to solve this problem, each of the second cutter bit plates 50B in the first embodiment has the structure as depicted in FIGS. 9 to 13. Thus, even in a situation where, during excavation of the ground M, a moment (arrowed line DS in FIG. 20) causing the second cutter bit plate 50B to be rotated about the axis extending along the circulating direction (direction orthogonal to the drawing sheet of FIG. 9) is generated due to reaction forces R (FIG. 20) received from the ground by the second excavation bits 12B, one of the pair of restraint plates 502 is brought into contact with a corresponding one of the guide portions 65 of the cutter post 6, to thereby restrain the rotation of the second cutter bit plate 50B. This makes it possible to reduce a shear force to be applied to the shoe bolt S1 fixedly fastening the second cutter bit plate 50B and the chain 11 together. As a result, it becomes possible to suppress loosening, disengagement, breakage or the like of the shoe bolt S1.

In the first embodiment, each of the pair of restraint plates 502 and the guide portions 65 in FIG. 9 has a shape extending long along the circulating movement direction of the chain 11. Thus, even in a situation where, during excavation of the ground M, a moment (the arrowed line DT in FIG. 6) causing the second cutter bit plate 50B to be rotated in a plane parallel to the plate body 501 is generated, the rotation of the cutter bit plate 50 is restrained by contact between the restraint plates 502 and the guide portions 65. This makes it possible to further reduce the shear force to be applied to the shoe bolt S1 fixing the cutter bit plate 50.

In the first embodiment, the rotational restraint and the circulating movement of each of the second cutter bit plates 50B are stably realized by the guide portions 65 made of a hard resin, a wear-resistant metal or the like. In the first embodiment, the guide portions 65 are disposed on the lateral walls 61 of the cutter post 6, so that, as compared to case where the guide portions 65 are disposed on the support walls 61 of the cutter post 6, it is possible to become free from complexity of the structure of the trench excavator 1 around the chain 11. This makes it possible to suppress a situation where excavated soil of the ground M stays around the chain 11 and disturbs the circulating movement of the chain 11 and the second cutter bit plates 50B (cutter bit plates 50).

In the first embodiment, the pair of restraint plates 502 are arranged to sandwich the cutter post 6 therebetween in the width direction, and contactable with a corresponding one of the guide portions 65 along the width direction, as depicted in FIG. 9. In this case, one of the restraint plates 502 is brought into contact with a corresponding one of the guide portions 65, along a direction intersecting with the reaction forces R received from the ground M by the second excavation bits 12B. This makes it possible to restrain rotation of each of the second cutter bit plates 50B while reducing a load to be imposed on the second cutter bit plate 50B. The above arrangement also makes it possible to enable a contact region between each of the restraint plates 502 and the cutter post 6 to be set at a position away (or isolated) from an excavation site of the ground M. Particularly, the arrangement in FIG. 9 is set such that the restraint plates 502 themselves prevent soil of the ground M from entering the contact region between each of the restraint plates 502 and a corresponding one of the guide portions 6 (see the arrowed lines DJ in FIG. 20). This makes it possible to suppress a situation where a rotational restraint function and a guide function of the arrangement is hindered by high-pressure soil lying in the contact region.

In the first embodiment, each of the second cutter bit plates 50B is disposed such that it is sandwiched between a pair of scrum plates 115 each firmly attached thereto, as depicted in FIGS. 6 and 7. Thus, the rotational moment as indicated by the arrowed line DT in FIG. 6 is much less likely to occur in each of the second cutter bit plates 50B.

In the first embodiment, each of the guide portions 65 has an outer peripheral surface with a gentle arc shape (arc surface, semi-spherical surface), as depicted in FIG. 9. Thus, a sliding resistance between each of the restraint plates 502 and a corresponding one of the guide portions 65 is reduced, as compared to case where flat surfaces of the restraint plate 502 and the guide portion 65 are brought into contact with each other in the contact region therebetween. This makes it possible to realize a smooth circulating movement of the chain 11 while keeping contact between each of the restraint plates 502 and a corresponding one of the guide portions 65. It should be noted that the outer peripheral surface of each of the guide portions 65 is not limited to an arc shape, but may be any other curved shape.

In the first embodiment, the reinforcement rib 503 is disposed at the base end of each of the restraint plates 502. This makes it possible to suppress fall-down of each of the restraint plates 502 with respect to the plate body 501, and thus stably maintain contact between each of the restraint plates 502 and the cutter post 6. As a result, it becomes possible to stably restrain the situation where each of the second cutter bit plates 50B is rotated about the axis extending along the circulating movement direction.

In the above embodiment, between the maximum span L of the second excavation bits 12B in FIG. 6 and the width d of the cutter post 6 in FIG. 20, the following relationship is satisfied: $L \geq d \times 2.5$, so that, even in the case where it is necessary to excavate a relatively wide region below the ground surface, it becomes possible to restrain the rotation of each of the second cutter bit plates 50B about the axis extending along the circulating movement direction, while stably performing the circulating movement of the chain 11 and the forward movement of the cutter post 6.

In the first embodiment, the cutter post 6 includes the pair of support walls 61 which support the chain 11 in a circulatingly movable manner, and the pair of lateral walls 60 arranged, respectably, on widthwise opposite-end sides of each of the pair of support walls 61, wherein each of the pair of lateral walls 60 has the restraining surface 6H. This makes it possible to assign a function of supporting the chain 11 and a function of restraining the rotation of each of the cutter bit plates 50 to different wall portions of the cutter post 6, respectively. Further, the reaction forces to be received from the ground M by the excavation bits 12 can be received by the lateral walls 60 of the cutter post 6. This makes it possible to stably restrain the rotation of each of the cutter bit plates 50 . The restraining surfaces 6H are provided, respectively, on the guide portions 65 each protruding from a respective one of the lateral walls 60, so that it becomes possible to restrain the rotation of each of the cutter bit plates 50 , irrespective of a shape of the base surfaces 60S.

Further, an excavating method using the trench excavator according to the first embodiment is designed to form a continuous trench below a ground surface by circulatingly moving a plurality of first cutter units 10A and a plurality of second cutter units 10B, integrally together with an endless-shaped chain 11, wherein the chain 11 is supported by a given cutter post 6 in such a manner as to be movable on an outer periphery of the cutter post 6 along a given circulating movement plane in a given circulating movement direction, and the first and second cutter units 10A, 10B are fixed to an outer peripheral surface of the chain 11 at intervals along the circulating movement direction, wherein each of the first and second cutter units 10A, 10B includes: a plate body having an obverse surface and a reverse surface; and a plurality of first excavation bits 12A or a plurality of second excavation bits 12B, arranged on the obverse surface of the plate body 501 at least at opposite ends thereof in a width direction of the chain 11 orthogonal to each of the circulating movement plane and the circulating movement direction, in opposed relation to a ground M below the ground surface. The excavating method includes excavating the ground M by the second excavation bits 12B, while causing a pair of restraint plates 502 disposed on both sides of and across the chain 11 in the width direction of the chain 11 to extend from the reverse surface of the plate body 501, to be brought into contact with the cutter post 6 along with the circulating movement of the chain 11 and a cutter bit plate 50, to thereby restrain each of the second cutter units 10B from being rotated about the axis extending along the circulating movement direction.

The above excavating method further includes excavating the ground by the second excavation bits 12B, while restraining fall-down of each of the restraint plates 502 with respect to the plate body 501 in a cross-section orthogonal to the circulating movement direction, by a reinforcement rib 503 disposed at a base end of the restraint plate 502 to connect the restraint plate 502 and the plate body 501 together.

In this excavating method, it is possible to restrain each of the second cutter bit plates 50B from being rotated about the axis extending along the circulating movement direction. This makes it possible to reduce a shear force to be applied to the shoe bolt S1 fixing the second cutter bit plate 50B.

In this excavating method, respective widths of the cutter post 6 and the second cutter bit plate 50B and an arrangement of the second excavation bits 12B arc set to satisfy the following relationship: $L \geq d \times 2.5$, where: d denotes a width of the cutter post 6 in the width direction; and L denotes a distance in the width direction between the second excavation bits 12B disposed at the opposite ends of the second cutter bit plate 50B.

In this excavating method, even in the case where it is necessary to excavate a relatively wide region below the ground surface, it becomes possible to reduce a shear force to be applied to the shoe bolt S1, while stably performing the circulating movement of the chain 11 and the forward movement of the cutter post 6.

Next, a trench excavator according to a second embodiment of the present invention and a ground excavating method using the trench excavator will be described. The second embodiment is different from the first embodiment mainly in terms of the structure of the second cutter bit plate 50B. Accordingly, description will be made mainly regarding the difference, and repeated description of other common features will be omitted. Further, in the following description, any element or member having the same structure and function as those of the element or member in the first embodiment will be described using the same reference sign assigned thereto.

Figure 14:
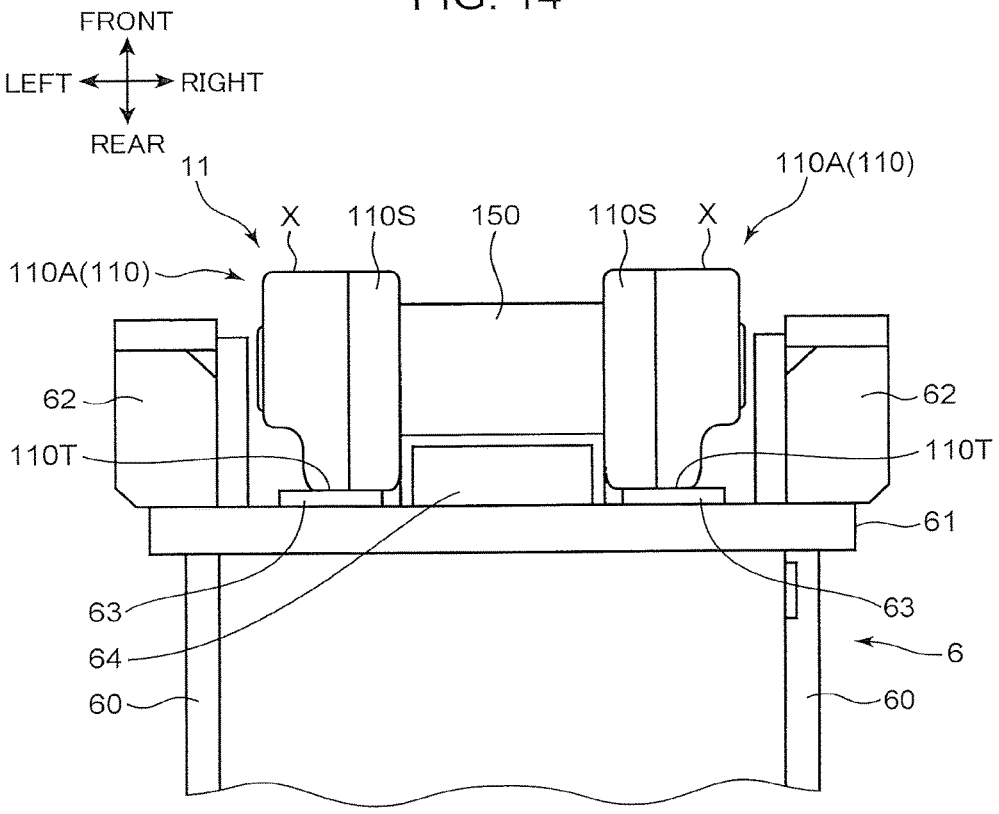
FIG. 14 is a sectional view depicting a support member and a chain of an excavating apparatus according to a second embodiment of the present invention.
Figure 15:
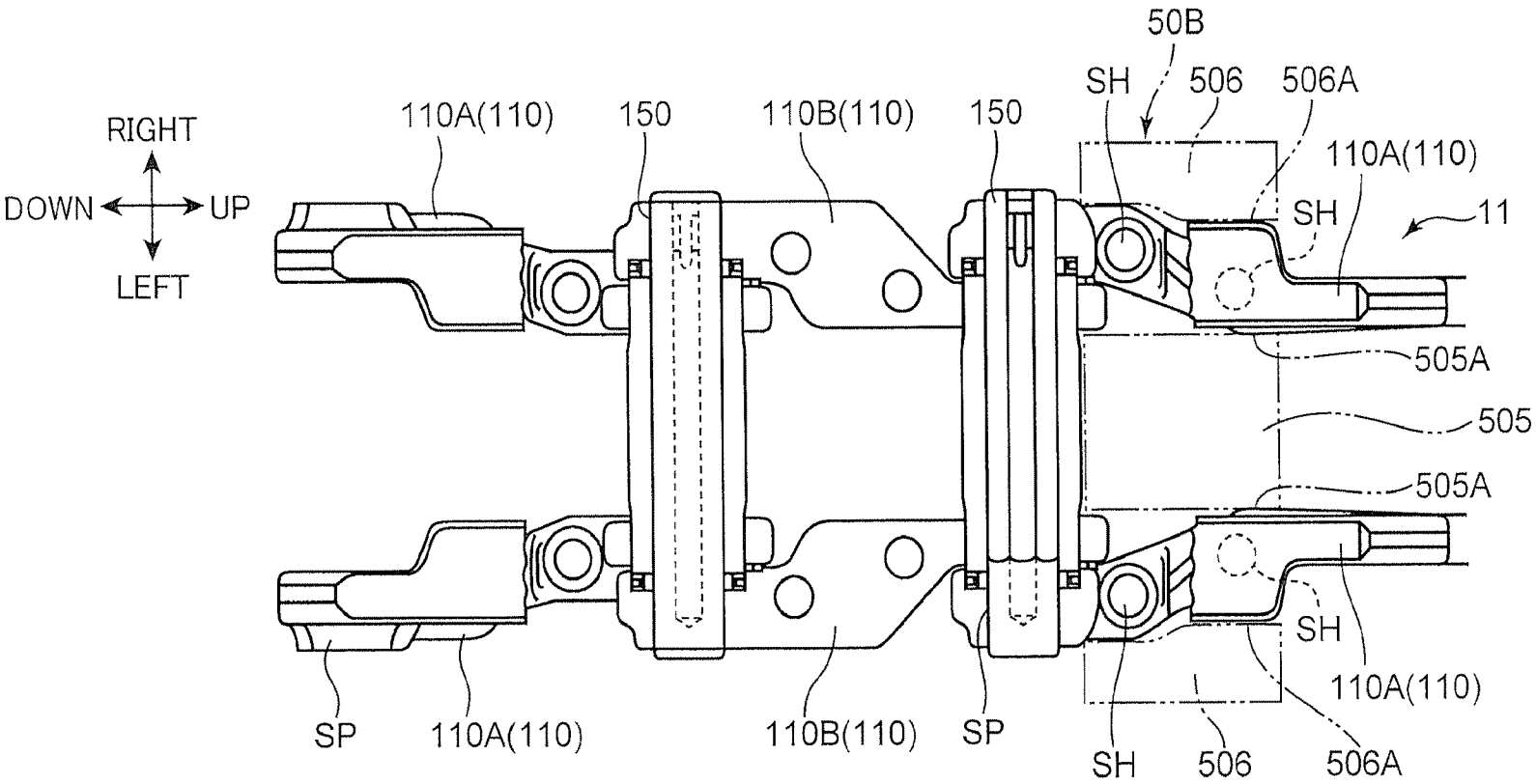
FIG. 15 is an enlarged front view depicting a portion of the chain of the excavating apparatus according to the second embodiment.
Figure 16:
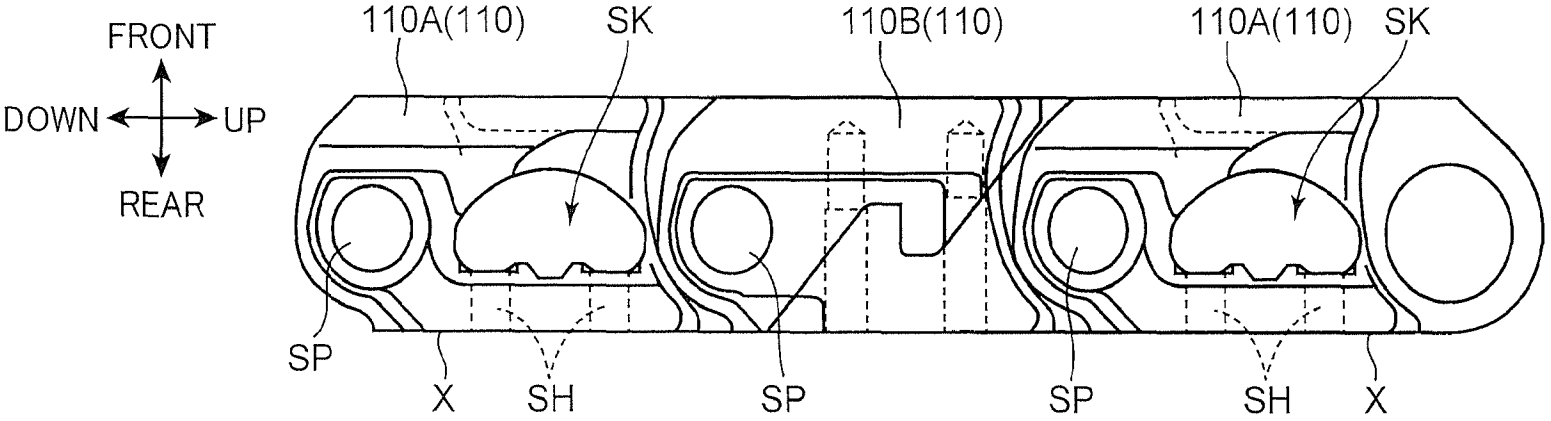
FIG. 16 is an enlarged side view depicting a portion of the chain of the excavating apparatus according to the second embodiment.
Figure 17:
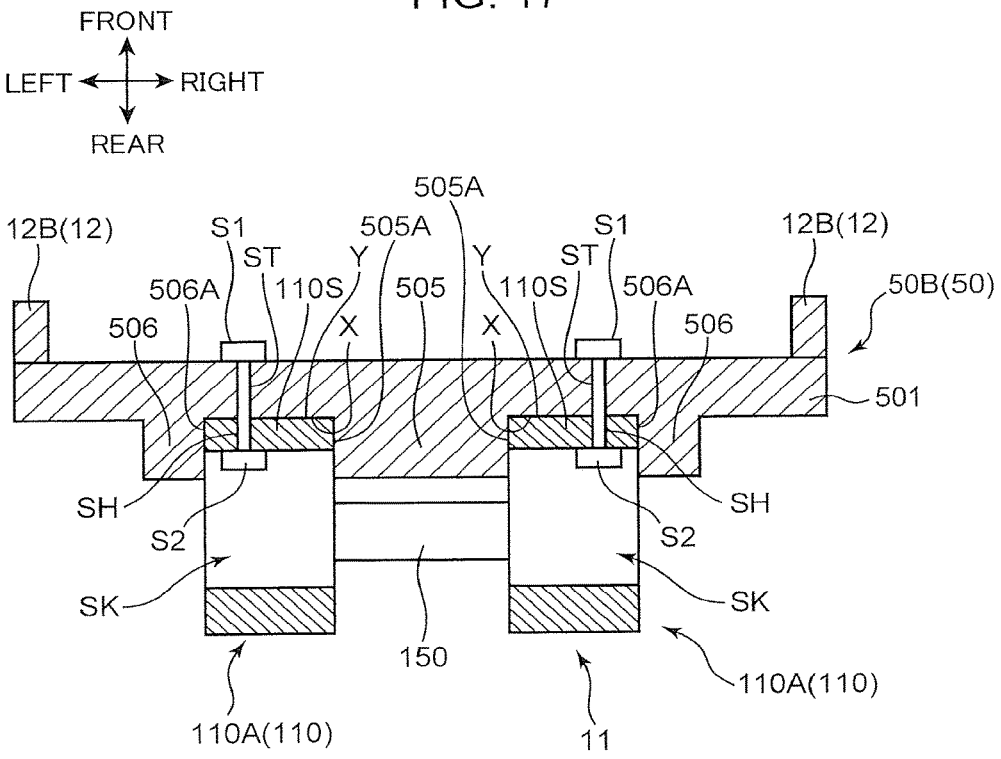
FIG. 17 is a sectional view depicting the chain and an excavation blade plate of the excavating apparatus according to the second embodiment.

FIG. 14 is a sectional view depicting a cutter post 6 and a chain 11 of the trench excavator 1 according to the second embodiment. FIG. 15 is an enlarged front view depicting a portion of the chain 11 of the trench excavator 1 according to the second embodiment, and FIG. 16 is an enlarged side view depicting a portion of the chain 11 of the trench excavator 1 according to the second embodiment. FIG. 17 is a sectional view depicting the chain 11 and a second cutter bit plate 50B of the trench excavator 1 according to the second embodiment.

Referring to FIG. 14, the cutter post 6 includes: a pair of lateral walls 60; a pair of support walls 61 each connecting the pair of lateral walls 60 together; a pair of opposing walls 62; a pair of sliding portions 6; and a pair of cutter post convex portions 64. It should be noted that, while FIG. 14 enlargedly depicts only a front end of the cutter post 6, the support wall 61, the pair of opposing walls 62, the pair of sliding portions 63 and the cutter post convex portion 64 are provided on the side of a rear end of the cutter post 6 in the same manner as that in FIG. 14.

The support wall 61 is a wall of the cutter post 6 supporting a chain-type cutter 10. The pair of opposing walls 62 are formed to protrude forwardly from opposite ends of each of the support walls 61 in a rightward-leftward direction. The chain 11 is received in a space between the pair of opposing walls 62. Each of the pair of sliding portions 63 is a plate-shaped member fixed to the support wall 61 at a position inward of the pair of opposing walls 62. As each of the sliding portions 63, a member having low frictional resistance and high slidability is employed. The cutter post convex portion 64 is a portion protruding from the support wall 61 at a position between the pair of sliding portions 63. The cutter post convex portion 64 is disposed between a pair of links 110A. Each of the opposing walls 62, the sliding portions 63 and the cutter post convex portion 64 extends long over the entire length of the cutter post 6 in the upward-downward direction, to have a function of guiding a circulating movement of the chain 11.

As depicted in FIGS. 14 and 17, when viewed in a cross-section orthogonal to a circulating movement direction of the chain 11, the pair of links 110A and a fixing pin 150 are formed in an approximately H-type shape. Each of the pair of links 110A includes a convex portion 110S and a sliding surface 110T. The convex portion 1105 is a portion of the link 110A protruding higher than the opposing walls 62. A distal end surface (outer peripheral surface) of the convex portion 1105 is formed as a plate supporting surface X. The plate supporting surface X has a function of supporting the cutter bit plates 50. The sliding surface 110T is a base end surface of the link 110A, and slidable with the pair of sliding portions 63 along with the circulating movement of the chain 11.

In FIGS. 15 and 16, a region of the chain 11 in which two links 110A are largely shown, respectively, on both sides of one half-link 110B. The link 110A and the half-link 110B are coupled together by the fixing pin 150, as described in connection with the first embodiment. For this purpose, each of opposite ends of the link 110A and the half-link 110E is formed with a pin insertion hole SP for allowing the fixing pin 150 to be inserted thereinto (FIG. 16). Further, each of the links 110A has the plate supporting surface X, a link hole portion SK, and a shoe bolt insertion hole SH. The link hole portion SK is opened in the link 110A at a position between pin insertion hole SP in the circulating movement direction of the chain 11. The shoe bolt insertion hole SH extends from the link hole portion SK to the plate supporting surface X to serve as a hole for bolt fastening.

On the other hand, referring to FIG. 17, each of a plurality of second cutter bit plates 50B fixed to the chain 11 includes a plate body 501, a central convex portion 505 (inward-side protruding portion), a pair of lateral convex portions 506 (outward-side protruding portions), and second excavation bits 12B.

The plate body 501 is a plate-shaped portion extending longer than the chain 11 in a width direction of the chain 11 (rightward-leftward direction), and has an obverse surface facing a ground M and a reverse surface on a side opposite to the obverse surface. The second excavation bits 12B are fixed at opposite ends of the obverse surface of the plate body 501. The reverse surface (on a rear side of FIG. 17) of the plate body 501 is formed as support-target surface Y. The support-target surfaces Y is a flat surface extending in the rightward-leftward direction, and configured to be brought into contact with and supported by a respective one of the plate supporting surfaces X (outer peripheral surface) of the chain 11. The central convex portion 505 of the second cutter bit plate 50B is a protruding portion protruding from a central region the support-target surfaces Y in the rightward-leftward direction. The pair of lateral convex portions 506 are a pair of protruding portions protruding from the support-target surfaces Y in such a manner as to be opposed to the central convex portion 505 in the width direction of the chain 11 (forward-rearward direction). Each of the pair of lateral convex portions 506 is disposed with a given distance with respect to the central convex portion 505. The pair of lateral convex portions 506 are arranged to clamp the pair of links 110A in cooperation with the central convex portion 505 in the width direction.

Referring to FIG. 15, an attaching position of the second cutter bit plate 50B is indicated by the one-dot chain line, around the pair of links 110A located upward of the pair of half-links 110B. In operation of attaching the second cutter bit plate 50B to the chain 11, the central convex portion 505 of the second cutter bit plate 50B is inserted into a space between the pair of links 110K. In this process, each of two outer side surfaces 505A of the central convex portion 505 is oriented in the width direction and brought into surface contact with a respective one of inner side surfaces of the pair of links 110A extending along the circulating movement direction. Further, each of the pair of lateral convex portions 506 clamps a respective one of the pair of links 110A along the width direction (right-left direction) in cooperation with the central convex portion 505, wherein an inner side surface 506A of each of the pair of lateral convex portions 506 is oriented in the width direction and brought into surface contact with an outer side surface of a corresponding one of the pair of links 110A extending along the circulating movement direction. As a result, the pair of lateral convex portions 506, the pair of links 110A and the central convex portion 505 are arranged along the width direction (rightward-leftward direction) in a tight contact manner. Further, as depicted in FIG. 17, the support-target surfaces Y of the second cutter bit plate 50B are supported, respectively, by the plate supporting surfaces X of the chain 11.

After attaching the second cutter bit plate 50B to the pair of links 110A, a shoe bolt S1 is inserted into a bolt hole ST of the cutter bit plate 50, as depicted in FIG. 17. A distal end of the shoe bolt S1 is inserted to penetrate through the shoe bolt insertion hole SH of the chain 11, and finally exposed to the link hole portion SK. Then, by an operator, a nut S2 is inserted from a lateral side of the chain 11 into the link hole portion SK, and attached and fixedly fastened to the distal end of the shoe bolt S1, so that the second cutter bit plate 50B is fixed to the chain 11. Each of the second cutter bit plates 50B is fixedly fastened to the chain 11 by four sets of a shoe bolt S1 and a nut S2, as described in connection with the first embodiment (FIG. 15). In this process, the shoe bolt S1 and the nut S2 fasten the chain 11 and the second cutter bit plate 50B along a direction parallel to a circulating movement plane of the chain 11 and orthogonal to the width direction of the chain 11 (forward-rearward direction), in such a manner that the outer peripheral surface of the chain 11 (strip members 11A, 11B) and the reverse surface of the plate body 501 come into press contact with each other.

In the second embodiment, each of the second cutter bit plates SOB of the second cutter unit 10B is fixed to the chain 11 by the structure as depicted in FIG. 17. On the other hand, each of a plurality of first cutter bit plates 50A of a first cutter unit 10A is devoid of the central convex portion 505 and the lateral convex portions 506 in FIG. 17. That is, a reverse surface of each of the first cutter bit plates 50A is entirely formed as a flat support-target surface Y along the rightward-leftward direction. In the first cutter unit 10A, each of the first cutter bit plates 50A is fixed to the chain 11 by four sets of a shoe bolt S1 and a nut S2, as with the second cutter unit 10B. In the first cutter unit 10A, the support-target surface Y of each of the first cutter bit plates 50A is supported by the plate supporting surfaces X of the chain 11.

As described with reference to FIG. 20 in connection with the first embodiment, in the case where the maximum span of the second excavation bits 12B of the second cutter bit plate 50B is set to be greater than the width d of the cutter post 6, the flow of excavated soil (arrowed lines DJ) is smoothly formed, so that it becomes possible to smoothly perform excavation operation for a wider excavation width W. Further, in the case where the maximum span L (FIG. 6) of the pair of second excavation bits 12B of the second cutter bit plate 50B is 1000 mm or more, the above effect is significantly brought out by satisfying the following relationship: $L \geq d \times 2.5$. On the other hand, the use of such a structure leads to problems of the rotational moments received by the second cutter bit plate 50B and the shear force S1 applied to the shoe bolt S1.

In order to solve this problem, each of the second cutter bit plates 50B in the second embodiment has the structure as depicted in FIGS. 15 to 17, in addition to the structure of the restraint plates 502 (FIG. 9) described in the first embodiment. That is, When each of the second cutter bit plates 50B is circulatingly moved around the cutter post 6 together with the chain 11 while excavating the ground M, each of the outer side surfaces 505A of the central convex portion 505 is in tight contact with a respective one of the inner side surfaces of the pair of links 110A. Further, the inner side surfaces 506A of each of the pair of lateral convex portions 506 is in tight contact with the outer side surface of a corresponding one of the pair of links 110A. Thus, even in a situation where, during excavation of the ground, a moment (the arrowed line DT in FIG. 6) causing the second cutter bit plate 50B to be rotated in a plane parallel to the plate body 501 due to the reaction forces R received from the ground by the second excavation bits 12B is likely to be generated, the rotation of the cutter bit plate 50 is restrained by contact between respective ones of the outer side surfaces 505A of the central convex portion 505 and the inner side surfaces of the pair of links 110A (pair of strip members 11A, 11B). This makes it possible to reduce a shear force to be applied to the shoe bolt S1 fixing the cutter bit plate 50. As a result, it becomes possible to suppress loosening, disengagement, breakage or the like of the shoe bolt S1. In other words, in the second embodiment, with a view to suppressing the rotation of each of the second cutter bit plates 50B in a cross-section orthogonal to the circulating movement direction of the chain-type cutter 10, each of the outer side surfaces 505A of the central convex portion 505 is in tight contact with a respective one of the inner side surfaces of the pair of links 110A, and the inner side surface of each of the pair of lateral convex portions 506 is in tight contact with the outer side surface of a corresponding one of the pair of links 110A.

In the second embodiment, each of the second cutter bit plates 50B is disposed such that it is sandwiched between a pair of scrum plates 115 each firmly attached thereto, as depicted in FIGS. 6 and 7, as with the first embodiment. Thus, the rotational moment as indicated by the arrowed line DT in FIG. 6 is much less likely to occur in each of the second cutter bit plates 50B.

In the second embodiment, each of a contact region between the central convex portion 505 of the second cutter bit plate 50B and each of the pair of links 110A, and a contact region between each of the pair of lateral convex portions 506 and a corresponding one of the pair of links 110A is set to a planar shape having a given length in the frontward-rearward direction and the upward-downward direction (set as a surface contact region), as depicted in FIG. 17. Thus, the rotational moment as indicated by the arrowed line DS in FIG. 20 is less likely to occur in the second cutter bit plate 50B. As a result, it becomes possible to reduce a shear force to be applied to the shoe bolt S1 to thereby further suppress occurrence of loosening, disengagement, breakage or the like of the shoe bolt S1.

In the second embodiment, as depicted in FIG. 15, the central convex portion 505 of the second cutter bit plate 50B is set to a shape fittable in the space between the pair of links 110A. This makes it possible to enable an operator to easily attach the second cutter bit plate 50B to a given position of the chain 11. In the second embodiment, the central convex portion 505 is fitted in the space between the pair of links 110A of the chain 11, and the pair of lateral convex portions 506 are fitted, respectively, on the outer side surfaces of the pair of links 110A, so that it becomes possible to restrain a shape of the chain 11 and prevent loosening of the chain 11. In this case, an edge face of the central convex portion 505 orthogonal to the two outer side surfaces 505A is disposed in opposed relation to the fixing pin 150 (FIG. 15).

In the second embodiment, the cutter bit plates 50 each having the excavation bits 12 are directly attached to the chain 11. Thus, as compared to case where an additional positioning member is disposed between the cutter bit plate 50 and the chain 11, it becomes possible to reduce a weight of the chain-type cutter 10 and thus reduce a load to be imposed on the chain 11 during the circulating movement.

In the second embodiment, between the maximum span L of the second excavation bits 12B in FIG. 6 and the width d of the cutter post 6 in FIG. 13, the following relationship is satisfied: $L \geq d \times 2.5$, as with the first embodiment, so that, even in the case where it is necessary to excavate a relatively wide region below the ground surface, it becomes possible to reduce a shear force to be applied to the shoe bolt S1, while stably performing the circulating movement of the chain 11 and the forward movement of the cutter post 6.

In the second embodiment, the endless-type chain 11 includes a pair of strip members 11A, 11B each formed in an endless shape and disposed with a distance therebetween in the width direction, and a fixing pin 150 coupling the pair of strip members 11A, 11B together in such a manner as to enable the distance between the pair of strip members 11A, 11B to be kept constant, wherein the second cutter bit plate 50B is fixed to an outer peripheral surface of the endless-type chain 11 supported by a given cutter post 6 in such a manner as to be movable on an outer periphery of the cutter post 6 along a given circulating movement plane in a given circulating movement direction. Further, each of the second cutter bit plates 50B includes: a plate body 501 extending longer than the chain 11 in a width direction of the chain 11 orthogonal to each of the circulating movement plane of the chain 11 and the circulating movement direction of the chain 11, and having an obverse surface and a reverse surface; a plurality of second excavation blades 12B arranged on the obverse surface of the plate body 501 at least at opposite ends thereof in the width direction, in opposed relation to a ground below the ground surface; a protruding portion formed to protrude from the reverse surface of the plate body 501 and inserted into a space between the pair of strip members 11A, 11B, wherein the protruding portion includes a central convex portion 505 having a pair of outer side surfaces 505A each being in surface contact with a respective one of inner side surfaces of the pair of strip members 11A, 11B extending in the circulating movement direction. Further, by plural sets of a shoe bolt S1 and a nut S2, each of the second cutter bit plates 50B is fastened to the chain 11, along a direction parallel to the circulating movement plane of the chain 11 and orthogonal to the width direction of the chain 11. As a result, the outer peripheral surface of the chain 11 and the reverse surface of the plate body 501 come into press contact with each other.

In the second embodiment, each of the second cutter bit plates 50B further includes a pair of lateral convex portions 506 each formed to protrude from the reverse surface of the plate body 501 in such a manner as to clamp a respective one of the pair of strip members 11A, 11B in the width direction in cooperation with the central convex portion 505, wherein each of the pair of lateral convex portions 506 has an inner side surface being in surface contact with an outer side surface of a corresponding one of the pair of strip members 11A, 11B extending along the circulating movement direction.

Further, an excavating method using the trench excavator according to the second embodiment is designed to form a continuous trench below a ground surface by circulatingly moving a plurality of second cutter bit plates 50B around a given cutter post 6, integrally together with an endless-shaped chain 11, wherein the chain 11 includes a pair of strip members 11A, 11B each formed in an endless shape and disposed with a given distance therebetween in the width direction, and a fixing pin 150 coupling the pair of strip members 11A, 11B together in such a manner as to enable the distance between the pair of strip members to be kept constant; and each of the second cutter bit plates 50B includes a plate body 501 having an obverse surface and a reverse surface, and a plurality of second excavation bits 12B arranged on the obverse surface of the plate body 501 at least at opposite ends thereof in the width direction, in opposed relation to a ground below the ground surface, wherein the plurality of second cutter bit plates 50B are fixed to an outer peripheral surface of the chain 11 at intervals along the circulating movement direction. The excavating method includes a preparation step and an excavation step. The preparation step includes: fittingly attaching each of the second cutter bit plates 50B to the chain 11 such that the central convex portion 505 protruding from the reverse surface of the plate body 501 of the second cutter bit plate 50B is inserted into a space between the pair of strip members 11A, 11B, wherein each of the pair of outer side surfaces of the central convex portion 505 extending along the circulating movement direction is brought into surface contact with the inner side surface of a respective one of the pair of strip members 11A, 11B extending along the circulating movement direction; and fastening, by plural sets of a shoe bolt S1 and a nut S2, the chain 11 and the second cutter bit plates 50B together along a direction parallel to the circulating movement plane and orthogonal to the width direction, in such a manner that the outer peripheral surface of the pair of strip members 11A, 11B and the reverse surface of the plate body 501 are brought into press contact with each other. The excavation step includes: circulatingly moving the chain 11 around the cutter post 6 and moving the cutter post 6 in a given forward movement direction to excavate the ground by the second excavation bits 12B, while restraining each of the second cutter bit plates 50B from being rotated in a plane parallel to the plate body 501 due to the reaction forces R received d from the ground to the second excavation bits 12B, by means of the contact between corresponding ones of the outer side surfaces 505A of the central convex portion 505 and the inner side surfaces of the pair of strip members 11A, 11B.

The preparation step also includes: providing a pair of lateral convex portions 506 formed to protrude from the reverse surface of the plate body 501, on both sides of and spaced-apart relation to the central convex portion 505 in the width direction; fittingly attaching each of the second cutter bit plates 50B to the chain 11 such that each of the pair of lateral convex portions 506 clamps a respective one of the pair of strip members 11A, 11*b* in the width direction in cooperation with the central convex portion 505, wherein an inner side surface 505A of each of the pair of central convex portions 505 extending along the circulating movement direction is brought into surface contact with an outer side surface of a corresponding one of the pair of strip members extending along the circulating movement direction; and fastening, by a shoe bolt S1, the chain 11 and the second cutter bit plates 50B together. Further, the excavation step includes: excavating the ground by the second excavation bits 12B, while further restraining each of the second cutter bit plates 50B from being rotated in the plane parallel to the plate body 501 due to the reaction forces R applied from the ground to the second excavation bits 12B, by means of the contact between corresponding ones of the inner side surfaces 506A of the lateral convex portions 506 and the outer side surfaces of the pair of strip members 11A, 11B.

In this excavating method, it becomes possible to reduce a moment given to each of the second cutter bit plates 50B during excavation of the ground, i.e., a moment causing the second cutter bit plate 50B to be rotated in a plane including the circulating movement direction of the chain 11 and the width direction of the chain 11. Further, it becomes possible to stably restrain the second cutter bit plate 50B to be rotated about the axis extending in the circulating movement direction of the chain 11. This makes it possible to reduce a shear force to be applied to the shoe bolt S1 fixing the second cutter bit plate 50B.

This excavating method is also characterized in that respective widths of the cutter post 6 and the second cutter bit plate 50B and an arrangement of the second excavation bits 12B are set to satisfy the following relationship: $L \geq d \times 2.5$, where: d denotes a width of the cutter post 6 in the width direction; and L denotes a distance in the width direction between the second excavation bits disposed at the opposite ends of the second cutter bit plate 50B.

In this excavating method, even in the case where it is necessary to excavate a relatively wide region below the ground surface, it becomes possible to reduce a shear force to be applied to the shoe bolt S1, while stably performing the circulating movement of the chain 11 and the forward movement of the cutter post 6.

As above, the trench excavator 1 according to each of the first and second embodiments of the present invention and the ground excavating method using the trench excavator 1 have been described. However, the present invention is not limited to these embodiments. For example, the above embodiments may be modified as follows.

(1) Although the first embodiment has been described based on an example where the outer peripheral surface of each of the guide portions 65 is formed in an arc (curved) shape as depicted in FIG. 9, the present invention is not limited thereto. For example, such a restraining mechanism may be configured such that the outer peripheral surface of the guide portion 65 is formed in a flat shape, and each of side surfaces of the restraint plates 502 contactable of a respective one of the guide portions 65 is formed in the above arc shape. Alternatively, the restraining mechanism may be configured such that a protruding portion having the same shape as that of the guide portion 65 is provided on each of the restraint plates 502, such that each of the protruding portions is directly brought into contact with a respective one of the lateral walls 60 of the cutter post 6. That is, in a contact region between each of the restraint plates 502 of the second cutter bit plate 50B and the cutter post 6, at least one of the restraint plate 502 and the cutter post 6 has a curved shape (arc shape) convexed toward the other.

Figure 18:
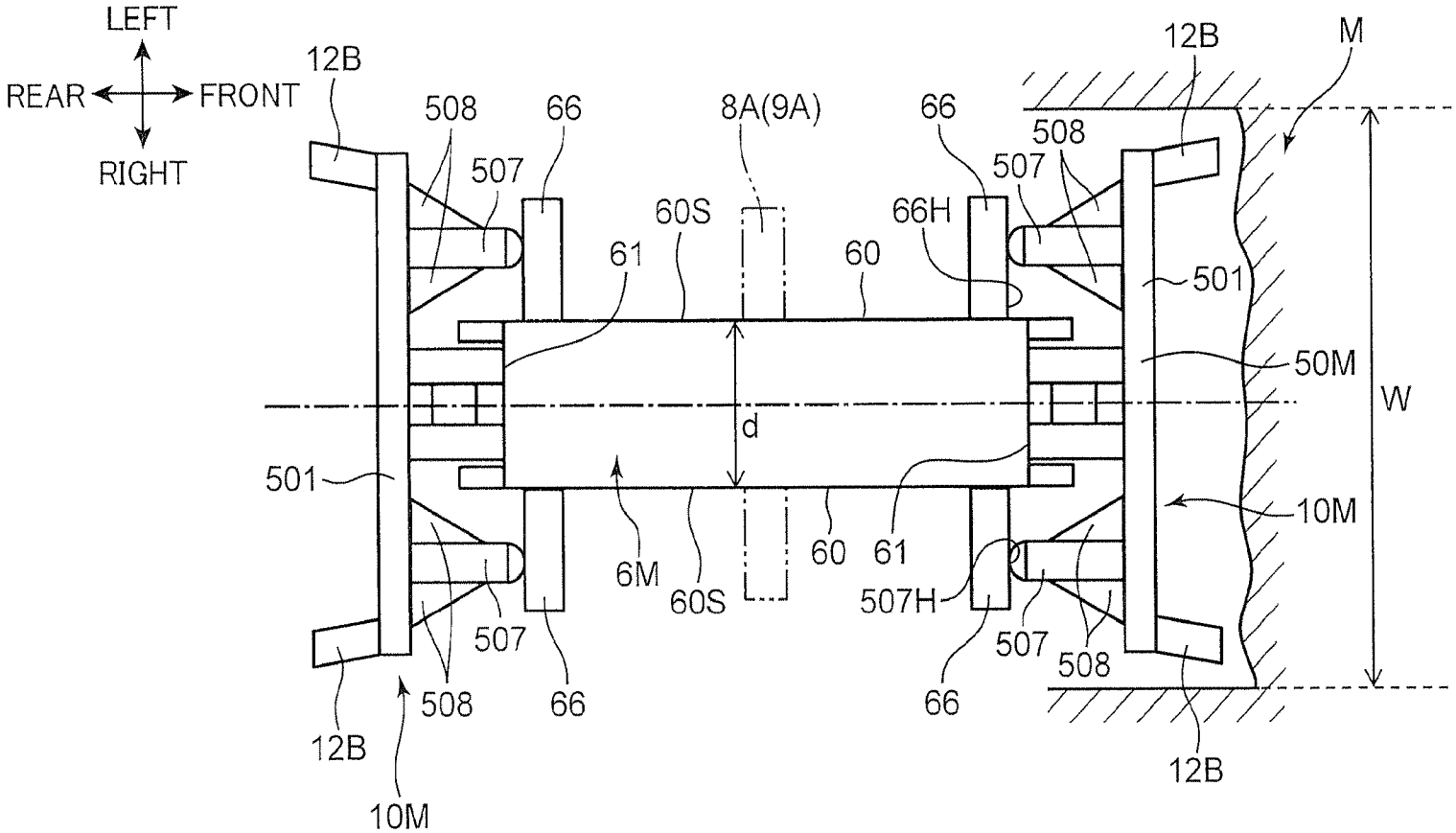
FIG. 18 is a schematic sectional view depicting structures of a support member and a chain-type cutter of an excavating apparatus according to one modified embodiment of the present invention.

FIG. 18 is a sectional view depicting a cutter post 6M and a chain-type cutter 10M of a trench excavator according to one modified embodiment of the present invention. As depicted in FIG. 18, in this modified embodiment, a pair of restraint plates 507 extends from the reverse surface of the plate body 501. The pair of restraint plates 507 are arranged on both side of the chain. A distal end of each of the restraint plates 507 has a semi-spherical shape. Further, a plurality of reinforcement ribs 508 are arranged at a base end of each of the restraint plates 507. Each of the restraint plates 507 has a restraint-target surface 507H.

On the other hand, the cutter post 6M includes a pair of guide portions (protruding portions) each provided to protrude from a respective one of the base surfaces 60S of the lateral walls 60. Each of the guide portions 66 has a restraint surface 66H. In FIG. 18, a downward path and an upward path in the circulating movement are depicted, so that two pairs of guide portion 66 are depicted. One pair of guide portions 66 opposed to the chain-type cutter 10M are arranged such that they extend, respectively, from the pair of lateral walls 60 in the width direction of the chain 11. Each of the guide portions 66 has a restraint surface 66H. Each of the restraint surfaces 507H of the restraint plates 507 is brought into contact with a respective one of the restraint surfaces 66H of the guide portions 66 along a direction parallel to the circulating movement surface of the chain 11 and orthogonal to the width direction of the chain 11 (i.e., along the forward-rearward direction).

In the above mechanism, a direction in which each of the cutter bit plates 50M receives the reaction forces R (FIG. 20) from the ground M is set to be approximately parallel to a contact direction of each of the restraint plates 507 with respect to a corresponding one of the guide portions 66. This makes it possible to more stably restrain the rotation of the cutter bit plate 50M about the axis extending along the circulating movement direction.

(2) Although the first and second embodiments have been described based on an example where each of the first cutter bit plates 50A is devoid of the restraint plates 502 and the reinforcement ribs 503 as in the second cutter bit plates 50B, the present invention is not limited thereto. For example, each of the first cutter bit plates 50A may be configured to include the restraint plates 502 and the reinforcement ribs 503, to thereby restrain rotation of the first cutter bit plate 50A.

Figure 19:
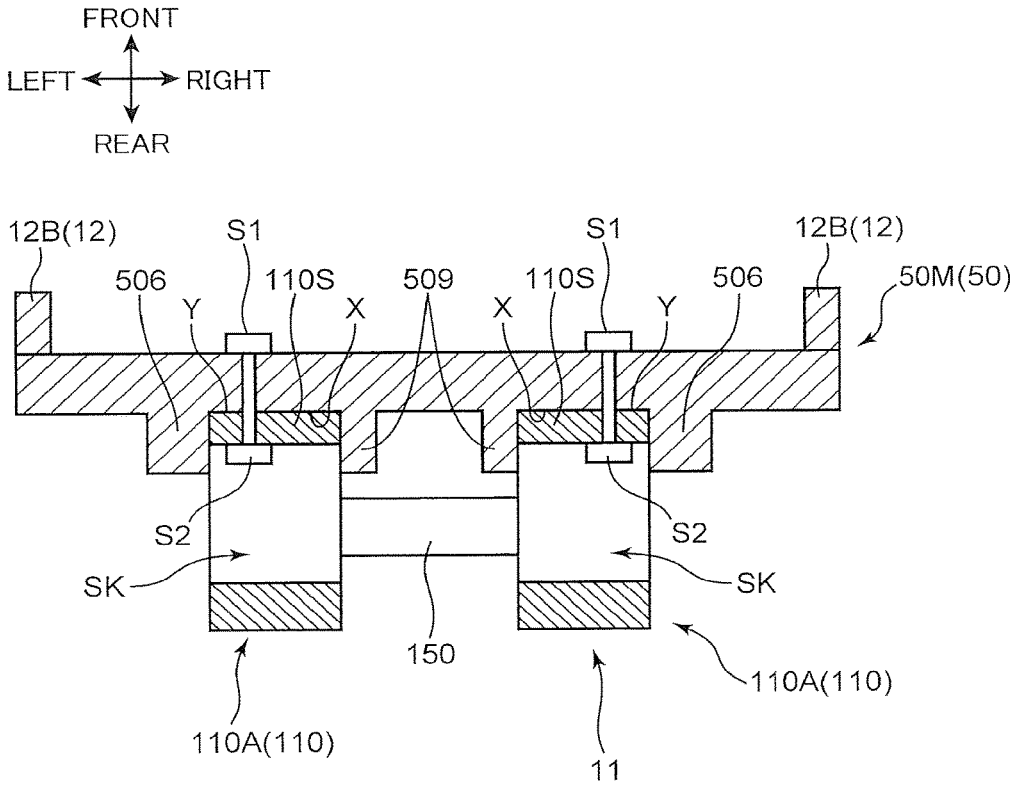
FIG. 19 is a sectional view depicting a chain and an excavation blade plate of the excavating apparatus according to the modified embodiment.

(3) Although the second embodiment has been described based on an example where each of the second cutter bit plates 50B includes the central convex portion 505 and the lateral convex portions 506, the present invention is not limited thereto. For example, the second cutter bit plate 50B may have only the central convex portion 505 or may have only the pair of lateral convex portions 506. FIG. 19 is a sectional view depicting a state in which a cutter bit plate 50M in another modified embodiment of the present invention is fixed to the chain 11. The cutter bit plate 50M in this modified embodiment is different from the second cutter bit plate 50B in the first and second embodiments, in that a pair of inward-side convex portions 509 (inward-side protruding portion) are provided, instead of the central convex portion 505. In this case, each of the pair of outward-side convex portions 509 comes into contact (surface contact) with a respective one of the inner side surfaces of the pair of links 110A along the circulating movement direction of the chain 11. Thus, the rotational moment as indicated by the arrowed line DT in FIG. 6 is less likely to occur in the cutter bit plates 50M. This makes it possible to reduce a shear force to be applied to the shoe bolt S1 to thereby suppress occurrence of loosening, disengagement, breakage or the like of the shoe bolt S1.

According to a first aspect of the present invention, there is provided an excavating apparatus for forming a continuous trench below a ground surface. The excavating apparatus includes: an apparatus body disposed on the ground surface; a support member suspended from the apparatus body and disposed below the ground surface; an endless-shaped chain supported by the support member in such a manner as to be movable on an outer periphery of the support member along a given circulating movement plane in a given circulating movement direction; a plurality of excavation blade plates fixed to an outer peripheral surface of the chain at intervals along the circulating movement direction of the chain, wherein each of the excavation blade plates includes: a plate body extending longer than the chain along a width direction of the chain orthogonal to each of the circulating movement plane of the chain and the circulating movement direction of the chain, and having an obverse surface and a reverse surface; and a plurality of excavation blades arranged on the obverse surface of the plate body at least at opposite ends thereof in the width direction, in opposed relation to a ground below the ground surface, the excavation blade plates being circulatingly movable integrally together with the chain to thereby excavate the ground; a plurality of fastening members fastening the chain and the excavation blade plates together along a direction parallel to the circulating movement plane and orthogonal to the width direction, in such a manner that the outer peripheral surface of the chain and the reverse surface of the plate body come into press contact with each other; a chain drive section which circulatingly moves the chain along the circulating movement direction; and a support member drive section which moves the support member along a given forward movement direction, wherein: the support member has a pair of restraining surfaces disposed in spaced-apart relation to each other in the width direction and each continuously extending along the circulating movement direction; and each of the excavation blade plates includes a pair of restraint members disposed on both sides of and across the chain in the width direction to extend from the reverse surface of the plate body, wherein the pair of restraint members has, respectively, a pair of restraint-target surfaces each contactable with a corresponding one of the restraining surfaces of the support member at an arbitrary position in the circulating movement direction, in such a manner as to enable each of the excavation blade plates to be restrained from being rotated about an axis extending along the circulating movement direction.

In the excavating apparatus of the present invention, even in a situation where, during excavation of the ground, a moment causing the excavation plate to be rotated about the axis extending along the circulating direction is generated due to the reaction forces R received from the ground by the excavation blades, one of the pair of restraint members is brought into contact with the support member, to thereby restrain the rotation of the excavation blade plate. This makes it possible to reduce a shear force to be applied to the fastening member fixing the excavation blade plate.

Preferably, in the excavating apparatus of the present invention, the support member is disposed such that each of the pair of restraining surfaces thereof faces outwardly in the width direction, and the pair of restraint members are arranged to sandwich the support member therebetween in the width direction, wherein each of the pair of restraint-target surfaces is disposed outward of and in opposed relation to a corresponding one of the restraining surfaces, in the width direction.

According to this feature, each of the restraint members is brought into contact with the support member along a direction intersecting with the reaction forces received from the ground by the excavation blades. This makes it possible to restrain rotation of each of the excavation blade plates while reducing a load to be imposed on the excavation blade plate. Further, it becomes possible to enable a contact region between each of the restraint members and the support member to be set at a position away (or isolated) from an excavation site of the ground. This makes it possible to suppress a situation where the rotational restraint function is hindered by high-pressure soil lying in the contact region.

Preferably, in the above excavating apparatus, the support member includes: a pair of support walls which support the chain in a circulatingly movable manner; and a pair of lateral walls arranged, respectably, on opposite-end sides of each of the pair of support walls in the width direction, wherein each of the pair of lateral walls has the restraining surface.

According to this feature, it becomes possible to assign a function of supporting the chain and a function of restraining the rotation of each of the excavation blade plates to different wall portions of the support member, respectively. Further, the reaction forces to be received from the ground by the excavation blades can be received by the lateral walls of the support member. This makes it possible to stably restrain the rotation of each of the excavation blade plates.

Preferably, in the above excavating apparatus, each of the pair of lateral walls includes: a base surface; and a protruding portion protruding from the base surface outwardly in the width direction and extending along the circulating movement direction, the protruding portion having the restraining surface.

According to this feature, the restraining surfaces are provided, respectively, on the protruding portions each protruding from a respective one of the lateral walls, so that it becomes possible to restrain the rotation of each of the excavation blade plates, irrespective of a shape of the base surfaces.

Preferably, in the excavating apparatus of the present invention, one of corresponding ones of the restraint-target surfaces of the pair of restraint members, and the pair of restraining surfaces of the support member, has a curved shape convexed toward the remaining one of them, in a cross-section orthogonal to the circulating movement direction.

According to this feature, a sliding resistance between each of the restraint members and the support member is reduced, as compared to case where flat surfaces are brought into contact with each other. This makes it possible to realize a smooth circulating movement of the chain while keeping contact between each of the restraint members and the support member.

Preferably, the excavating apparatus of the present invention further includes a fall-down restraining member disposed at a base end of each of the pair of restraint members to restrain fall-down of the restraint member with respect to the plate body in a cross-section orthogonal to the circulating movement direction.

According to this feature, it becomes possible to suppress fall-down of each of the restraint members with respect to the plate body, and thus stably maintain contact between each of the restraint members and the support member. This makes it possible to stably restrain the situation where each of the excavation blade plates is rotated about the axis extending along the circulating movement direction.

Preferably, in the excavating apparatus of the present invention, the chain includes: a pair of strip members each formed in an endless shape and disposed with a distance therebetween in the width direction, wherein each of the pair of strip members has the outer peripheral surface; and a coupling member coupling the pair of strip members together in such a manner as to enable the distance between the pair of strip members to be kept constant, and each of the excavation blade plates includes an inward-side protruding portion formed to protrude from the reverse surface of the plate body and inserted into a space between the pair of strip members, wherein the inward-side protruding portion has a pair of outer side surfaces each being in surface contact with a respective one of inner side surfaces of the pair of strip members extending along the circulating movement direction.

According to this feature, even in a situation where, during excavation of the ground, a moment causing the excavation blade plate to be rotated in a plane parallel to the plate body due to reaction forces received from the ground by the excavation blades is generated, the rotation of the excavation blade plate is restrained by contact between respective ones of the outer side surfaces of the inward-side protruding portion and the inner side surfaces of the pair of strip members. This makes it possible to reduce a shear force to be applied to the fastening member fixing the excavation blade plate. As a result, it becomes possible to suppress loosening, disengagement, breakage or the like of the fastening member.

Preferably, in the above excavating apparatus, each of the excavation blade plates further includes a pair of outward-side protruding portions each formed to protrude from the reverse surface of the plate body in such a manner as to clamp a respective one of the pair of strip members in the width direction in cooperation with the inward-side protruding portion, each of the pair of outward-side protruding portions having an inner side surface being in surface contact with an outer side surface of a corresponding one of the pair of strip members extending along the circulating movement direction.

According to this feature, it becomes possible to further restrain the rotation of each of the excavation blade plates by means of the contact between corresponding ones of the inner side surfaces of the outward-side protruding portions and the outer side surfaces of the pair of strip members. This makes it possible to further suppress loosening, disengagement, breakage or the like of the fastening member.

Preferably, the excavating apparatus of the present invention satisfies the following relationship: $L \geq d \times 2.5$, where: d denotes a width of the support member in the width direction; and L denotes a distance in the width direction between the excavation blades disposed at the opposite ends of the excavation blade plate.

According to this feature, even in a case where it is necessary to excavate a relatively wide region below the ground surface, it becomes possible to restrain the rotation of the excavation blade plate around the axis extending along the circulating movement direction, while stably performing the circulating movement of the chain and the forward movement of the support member. This makes it possible to reduce a shear force to be applied to the fastening member.

According to another aspect of the present invention, there is provided an excavating method for forming a continuous trench below a ground surface by circulatingly moving a plurality of excavation blade plates integrally together with an endless-shaped chain, wherein the endless-shaped chain is supported by a given support member in such a manner as to be movable on an outer periphery of the support member along a given circulating movement plane in a given circulating movement direction, and the plurality of excavation blade plates are fixed to an outer peripheral surface of the chain at intervals along the circulating movement direction, whereon each of the excavation blade plates including: a plate body having an obverse surface and a reverse surface; and a plurality of excavation blades arranged on the obverse surface of the plate body at least at opposite ends thereof in a width direction of the chain orthogonal to each of the circulating movement plane and the circulating movement direction, in opposed relation to a ground below the ground surface. The excavating method including an excavation step of excavating the ground by the excavation blades, while causing a pair of restraint members disposed on both sides of and across the chain in the width direction of the chain to extend from the reverse surface of the plate body of each of the excavation blade plates, to be brought into contact with the support member along with the circulating movement of the chain and the excavation blade plates, to thereby restrain each of the excavation blade plates from being rotated about an axis extending along the circulating movement direction.

In this excavating method, it is possible to restrain each of the excavation blade plates from being rotated about the axis extending along the circulating movement direction. This makes it possible to perform the excavation operation while reducing a shear force to be applied to the fastening member fixing the excavation blade plate.

In the excavating method of the present invention, the excavation step may include excavating the ground by the excavation blades, while restraining fall-down of each of the pair of restraint members with respect to the plate body in a cross-section orthogonal to the circulating movement direction, by a reinforcement member disposed at a base end of the restraint member to connect the restraint member and the plate body together.

According to this feature, it becomes possible to stably restrain the situation where each of the excavation blade plates is rotated about the axis extending along the circulating movement direction during excavation of the ground.

The excavating method of the present invention may further include a preparation step of: providing, as the chain, a chain in which a pair of strip members each formed in an endless shape and disposed with a distance therebetween in the width direction orthogonal to the circulating movement direction are coupled together by a given coupling member in such a manner as to enable the distance to be kept constant; fittingly attaching each of the excavation blade plates to the chain such that an inward-side protruding portion protruding from the reverse surface of the plate body of the excavation blade plate is inserted into a space between the pair of strip members, wherein each of a pair of outer side surfaces of the inward-side protruding portion extending along the circulating movement direction is brought into surface contact with an inner side surface of a respective one of the pair of strip members extending along the circulating movement direction; and fastening, by a plurality of fastening members, the chain and the excavation blade plates together along a direction parallel to the circulating movement plane and orthogonal to the width direction, in such a manner that the outer peripheral surface of the chain and the reverse surface of the plate body of each of the excavation blade plates are brought into press contact with each other, wherein the excavation step may include: circulatingly moving the chain around the support member and moving the support member along a given forward movement direction to excavate the ground by the excavation blades, while restraining each of the excavation blade plates from being rotated in a plane parallel to the plate body due to a reaction force applied from the ground to the excavation blades, by means of the contact between corresponding ones of the outer side surfaces of the inward-side protruding portion and the inner side surfaces of the pair of strip members.

According to this feature, it becomes possible to perform the excavation operation while further reducing the shear force to be applied to the fastening member fixing the excavation blade plate, during excavation of the ground.

In the above excavating method, the preparation step may include: providing a pair of outward-side protruding portions formed to protrude from the reverse surface of the plate body, on both sides of and spaced-apart relation to the inward-side protruding portion in the width direction; fittingly attaching each of the excavation blade plates to the chain such that each of the pair of outward-side protruding portions clamps a respective one of the pair of strip members in the width direction in cooperation with the inward-side protruding portion, wherein an inner side surface of each of the pair of outward-side protruding portions extending along the circulating movement direction is brought into surface contact with an outer side surface of a respective one of the pair of strip members extending along the circulating movement direction; and fastening, by a plurality of fastening members, the chain and the excavation blade plates together, wherein the excavation step may include: excavating the ground by the excavation blades, while further restraining each of the excavation blade plates from being rotated in the plane parallel to the plate body due to the reaction force applied from the ground to the excavation blades, by means of the contact between corresponding ones of the inner side surfaces of the pair of outward-side protruding portions and the outer side surfaces of the pair of strip members.

According to this feature, it becomes possible to perform the excavation operation while further reducing the shear force to be applied to the fastening member fixing the excavation blade plate, during excavation of the ground.

In the excavating method of the present invention, respective widths of the support member and the plate body and an arrangement of the excavation blades may be set to satisfy the following relationship: $L \geq d \times 2.5$, where: d denotes a width of the support member in the width direction; and L denotes a distance in the width direction between the excavation blades disposed at the opposite ends of the excavation blade plate.

According to this feature, even in a case where it is necessary to excavate a relatively wide region below the ground surface, it becomes possible to restrain the rotation of the excavation blade plate around the axis extending along the circulating movement direction. This makes it possible to perform the excavation operation while reducing the shear force to be applied to the fastening member.

This application is based on Japanese Patent application No. 2016-195950 filed in Japan Patent Office on Oct. 3, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An excavating apparatus for forming a continuous trench below a ground surface, comprising:

an apparatus body disposed on the ground surface;

a support member suspended from the apparatus body and disposed below the ground surface;

an endless-shaped chain supported by the support member in such a manner as to be movable on an outer periphery of the support member along a given circulating movement plane in a given circulating movement direction;

a plurality of excavation blade plates fixed to an outer peripheral surface of the chain at intervals along the circulating movement direction of the chain, each of the excavation blade plates including: a plate body extending longer than the chain in a width direction of the chain orthogonal to each of the circulating movement plane of the chain and the circulating movement direction of the chain, and having an obverse surface and a reverse surface; and a plurality of excavation blades arranged on the obverse surface of the plate body at least at opposite ends thereof in the width direction, in opposed relation to a ground below the ground surface, the excavation blade plates being circulatingly movable integrally together with the chain to thereby excavate the ground;

a plurality of fastening members fastening the chain and the excavation blade plates together in a direction parallel to the circulating movement plane and orthogonal to the width direction, in such a manner that the outer peripheral surface of the chain and the reverse surface of the plate body come into press contact with each other;

a chain drive section which circulatingly moves the chain in the circulating movement direction; and a support member drive section which moves the support member in a given forward movement direction, wherein:

the support member has a pair of restraining surfaces disposed in spaced-apart relation to each other in the width direction and each continuously extending in the circulating movement direction; and each of the excavation blade plates includes a pair of restraint members disposed on both sides of and across the chain in the width direction to extend from the reverse surface of the plate body, the pair of restraint members having, respectively, a pair of restraint-target surfaces each contactable with a corresponding one of the restraining surfaces of the support member at an arbitrary position in the circulating movement direction, in such a manner as to enable each of the excavation blade plates to be restrained from being rotated about an axis extending in the circulating movement direction.

2. The excavating apparatus as recited in claim 1, wherein the support member is disposed such that each of the pair of restraining surfaces thereof faces outwardly in the width direction, and the pair of restraint members are arranged to sandwich the support member therebetween in the width direction, wherein each of the pair of restraint-target surfaces is disposed outward of and in opposed relation to a corresponding one of the restraining surfaces, in the width direction.

3. The excavating apparatus as recited in claim 2, wherein the support member includes:

a pair of support walls which support the chain in a circulatingly movable manner; and a pair of lateral walls arranged, respectably, on opposite-end sides of each of the pair of support walls in the width direction, each of the pair of lateral walls having the restraining surface.

4. The excavating apparatus as recited in claim 3, wherein each of the pair of lateral walls includes:

a base surface; and a protruding portion protruding from the base surface outwardly in the width direction and extending in the circulating movement direction, the protruding portion having the restraining surface.

5. The excavating apparatus as recited in claim 1, wherein one of corresponding ones of the restraint-target surfaces of the pair of restraint members, and the pair of restraining surfaces of the support member, has a curved shape convexed toward the remaining one of them, in a cross-section orthogonal to the circulating movement direction.

6. The excavating apparatus as recited in claim 1, which further comprises a fall-down restraining member disposed at a base end of each of the pair of restraint members to restrain fall-down of the restraint member with respect to the plate body in a cross-section orthogonal to the circulating movement direction.

7. The excavating apparatus as recited in claim 1, wherein:

the chain includes a pair of strip members each formed in an endless shape and disposed with a distance therebetween in the width direction, each of the pair of strip members having the outer peripheral surface, and a coupling member coupling the pair of strip members together in such a manner as to enable the distance between the pair of strip members to be kept constant; and each of the excavation blade plates includes an inward-side protruding portion formed to protrude from the reverse surface of the plate body and inserted into a space between the pair of strip members, the inward-side protruding portion having a pair of outer side surfaces each being in surface contact with a respective one of inner side surfaces of the pair of strip members extending in the circulating movement direction.

8. The excavating apparatus as recited in claim 7, wherein each of the excavation blade plates further includes a pair of outward-side protruding portions each formed to protrude from the reverse surface of the plate body in such a manner as to clamp a respective one of the pair of strip members in the width direction in cooperation with the inward-side protruding portion, each of the pair of outward-side protruding portions having an inner side surface being in surface contact with an outer side surface of a corresponding one of the pair of strip members extending in the circulating movement direction.

9. The excavating apparatus as recited in claim 1, which satisfies the following relationship: $L \geq d \times 2.5$, where: d denotes a width of the support member in the width direction; and L denotes a distance in the width direction between the excavation blades disposed at the opposite ends of the excavation blade plate.

10. An excavating method for forming a continuous trench below a ground surface by circulatingly moving a plurality of excavation blade plates integrally together with an endless-shaped chain, wherein the endless-shaped chain is supported by a given support member in such a manner as to be movable on an outer periphery of the support member along a given circulating movement plane in a given circulating movement direction, and the plurality of excavation blade plates are fixed to an outer peripheral surface of the chain at intervals in the circulating movement direction, each of the excavation blade plates including: a plate body having an obverse surface and a reverse surface; and a plurality of excavation blades arranged on the obverse surface of the plate body at least at opposite ends thereof in a width direction of the chain orthogonal to each of the circulating movement plane and the circulating movement direction, in opposed relation to a ground below the ground surface, the excavating method comprising an excavation step of excavating the ground by the excavation blades, while causing a pair of restraint members disposed on both sides of and across the chain in the width direction of the chain to extend from the reverse surface of the plate body of each of the excavation blade plates, to be brought into contact with the support member along with the circulating movement of the chain and the excavation blade plates, to thereby restrain each of the excavation blade plates from being rotated about an axis extending along the circulating movement direction.

11. The excavating method as recited in claim 10, wherein the excavation step includes excavating the ground by the excavation blades, while restraining fall-down of each of the pair of restraint members with respect to the plate body in a cross-section orthogonal to the circulating movement direction, by a member disposed at a base end of the restraint member to support the restraint member.

12. The excavating method as recited in claim 10, which further comprises a preparation step of:

providing, as the chain, a chain in which a pair of strip members each formed in an endless shape and disposed with a distance therebetween in the width direction orthogonal to the circulating movement direction are coupled together by a given coupling member in such a manner as to enable the distance to be kept constant;

fittingly attaching each of the excavation blade plates to the chain such that an inward-side protruding portion protruding from the reverse surface of the plate body of the excavation blade plate is inserted into a space between the pair of strip members, wherein each of a pair of outer side surfaces of the inward-side protruding portion extending along the circulating movement direction is brought into surface contact with an inner side surface of a respective one of the pair of strip members extending along the circulating movement direction; and fastening, by a plurality of fastening members, the chain and the excavation blade plates together in a direction parallel to the circulating movement plane and orthogonal to the width direction, in such a manner that the outer peripheral surface of the chain and the reverse surface of the plate body of each of the excavation blade plates are brought into press contact with each other, wherein the excavation step includes: circulatingly moving the chain around the support member and moving the support member in a given forward movement direction to excavate the ground by the excavation blades, while restraining each of the excavation blade plates from being rotated in a plane parallel to the plate body due to reaction forces applied from the ground to the excavation blades, by means of the contact between corresponding ones of the outer side surfaces of the inward-side protruding portion and the inner side surfaces of the pair of strip members.

13. The excavating method as recited in claim 12, wherein:

the preparation step includes:

providing a pair of outward-side protruding portions formed to protrude from the reverse surface of the plate body, on both sides of and spaced-apart relation to the inward-side protruding portion in the width direction;

fittingly attaching each of the excavation blade plates to the chain such that each of the pair of outward-side protruding portions clamps a respective one of the pair of strip members in the width direction in cooperation with the inward-side protruding portion, wherein an inner side surface of each of the pair of outward-side protruding portions extending in the circulating movement direction is brought into surface contact with an outer side surface of a respective one of the pair of strip members extending in the circulating movement direction; and fastening, by the plurality of fastening members, the chain and the excavation blade plates together, wherein the excavation step includes: excavating the ground by the excavation blades, while further restraining each of the excavation blade plates from being rotated in the plane parallel to the plate body due to the reaction forces applied from the ground to the excavation blades, by means of the contact between corresponding ones of the inner side surfaces of the pair of outward-side protruding portions and the outer side surfaces of the pair of strip members.

14. The excavating method as recited in claim 10, wherein respective widths of the support member and the plate body and an arrangement of the excavation blades are set to satisfy the following relationship: $L \geq d \times 2.5$, where: d denotes a width of the support member in the width direction; and L denotes a distance in the width direction between the excavation blades disposed at the opposite ends of the excavation blade plate.

* * * * *